US010683147B2

(12) United States Patent
Choltco-Devlin et al.

(10) Patent No.: US 10,683,147 B2
(45) Date of Patent: Jun. 16, 2020

(54) BEVERAGE CONTAINER LID WITH ADJUSTABLE FLOW RATE

(71) Applicant: Pacific Market International, LLC, Seattle, WA (US)

(72) Inventors: Evan Michael Choltco-Devlin, Ellensburg, WA (US); Jacob D. Silsby, Seattle, WA (US)

(73) Assignee: Pacific Market International, LLC, Seattle, WA (US)

( * ) Notice: Subject to any disclaimer, the term of this patent is extended or adjusted under 35 U.S.C. 154(b) by 83 days.

(21) Appl. No.: 15/785,310

(22) Filed: Oct. 16, 2017

(65) Prior Publication Data

US 2019/0112112 A1 Apr. 18, 2019

Related U.S. Application Data

(60) Provisional application No. 62/572,329, filed on Oct. 13, 2017.

(51) Int. Cl.

| | |
|---|---|
| ***B65D 47/26*** | (2006.01) |
| ***B65D 43/02*** | (2006.01) |
| ***B65D 47/24*** | (2006.01) |
| ***A47G 19/22*** | (2006.01) |

(52) U.S. Cl.

CPC ..... *B65D 47/265* (2013.01); *A47G 19/2205* (2013.01); *B65D 43/0225* (2013.01); *B65D 47/244* (2013.01)

(58) Field of Classification Search

CPC ..... B65D 47/00; B65D 47/06; B65D 47/068; B65D 47/265; B65D 25/48; B65D 43/0225

See application file for complete search history.

(56) References Cited

U.S. PATENT DOCUMENTS

| | | | |
|---|---|---|---|
| D363,666 | S | 10/1995 | Goto et al. |
| D485,759 | S | 1/2004 | Janky et al. |
| D490,710 | S | 6/2004 | Bayer et al. |
| D609,092 | S | 2/2010 | Laib et al. |
| D623,017 | S | 9/2010 | George |
| D644,060 | S | 8/2011 | Komeiji |
| D647,753 | S | 11/2011 | Lin |
| D674,663 | S | 1/2013 | Cahen |
| D691,416 | S | 10/2013 | Eyal |

(Continued)

OTHER PUBLICATIONS

"Stanley Hydrate and Go Bottle," 1 page, Stanley product publicly disclosed prior to Apr. 6, 2017.

(Continued)

*Primary Examiner* — Steven A. Reynolds
*Assistant Examiner* — Javier A Pagan
(74) *Attorney, Agent, or Firm* — Davis Wright Tremaine LLP; George C. Rondeau, Jr.; Heather M. Colburn

(57) ABSTRACT

A lid assembly that includes a lid body member, a stopper, and a flow control. The lid body member includes a pouring aperture configured to allow a fluid to flow therethrough. The stopper allows the fluid to flow through the pouring aperture at first and second flow rates when the stopper is positioned in first and second open positions, respectively. The second flow rate is faster than the first flow rate. The flow control is operable to position the stopper in the first and second open positions.

35 Claims, 11 Drawing Sheets

(56) References Cited

U.S. PATENT DOCUMENTS

| | | | | |
|---|---|---|---|---|
| 8,636,166 | B2 * | 1/2014 | Lane | B65D 47/242 215/228 |
| D709,734 | S | 7/2014 | Kotani | |
| D719,023 | S | 12/2014 | Hu et al. | |
| D721,535 | S | 1/2015 | Chapman et al. | |
| D732,337 | S | 6/2015 | Coon | |
| D755,048 | S | 5/2016 | Baissero et al. | |
| 9,334,090 | B1 | 5/2016 | Maple et al. | |
| D761,618 | S | 7/2016 | Lapsker | |
| D772,651 | S | 11/2016 | Leonard et al. | |
| 9,643,758 | B2 | 5/2017 | George | |
| D789,737 | S | 6/2017 | Eyal | |
| D794,455 | S | 8/2017 | Rummel et al. | |
| D801,746 | S | 11/2017 | Thuma et al. | |
| D805,838 | S | 12/2017 | Guthrie | |
| D806,545 | S | 1/2018 | Circosta et al. | |
| D807,692 | S | 1/2018 | Yao | |
| 9,901,201 | B2 | 2/2018 | Shen | |
| D814,240 | S | 4/2018 | Kabalin | |
| D814,857 | S | 4/2018 | Rolfson | |
| D816,399 | S | 5/2018 | Burns | |
| D818,312 | S | 5/2018 | Burns | |
| D820,036 | S | 6/2018 | Lonner | |
| 10,000,319 | B2 | 6/2018 | Pisarevsky | |
| 10,023,366 | B2 | 7/2018 | Gilbert | |
| 10,064,506 | B2 | 9/2018 | Coon | |
| D830,119 | S | 10/2018 | Sorensen | |
| 10,086,985 | B2 | 10/2018 | Klatt | |
| 10,105,012 | B2 | 10/2018 | Yurkovetskaya | |
| D836,386 | S | 12/2018 | Ayriss | |
| D836,395 | S | 12/2018 | Seiders | |
| D836,974 | S | 1/2019 | Seiders | |
| D843,174 | S | 3/2019 | Zhang | |
| D850,259 | S | 6/2019 | Wiggins | |
| D851,445 | S | 6/2019 | Silsby | |
| D852,577 | S | 7/2019 | Markey | |
| 10,368,666 | B2 | 8/2019 | Yekutiely | |
| 2003/0150834 | A1 | 8/2003 | Verderber | |
| 2007/0196542 | A1 | 8/2007 | Rathbone et al. | |
| 2012/0097690 | A1 | 4/2012 | Chien | |
| 2013/0140309 | A1 * | 6/2013 | George | A47G 19/2272 220/254.1 |
| 2013/0228586 | A1 | 9/2013 | Schandl | |
| 2016/0264312 | A1 | 9/2016 | Choltco-Devlin | |
| 2017/0208832 | A1 | 7/2017 | Erhart | |
| 2017/0225850 | A1 | 8/2017 | Sorensen et al. | |
| 2017/0253392 | A1 | 9/2017 | Ban | |
| 2017/0253396 | A1 | 9/2017 | Coon et al. | |
| 2017/0320643 | A1 | 11/2017 | Green | |
| 2018/0050844 | A1 * | 2/2018 | Hirst | A47G 21/18 |
| 2018/0178046 | A1 | 6/2018 | Kekeba | |
| 2018/0186529 | A1 | 7/2018 | Tonn | |
| 2018/0346221 | A1 | 12/2018 | Watts | |
| 2019/0100362 | A1 | 4/2019 | Meyers | |
| 2019/0112112 | A1 | 4/2019 | Choltco-Devlin | |
| 2019/0168932 | A1 | 6/2019 | Jevtic | |

OTHER PUBLICATIONS

Hydro Flask Lids: Announced Oct. 8, 2016 [online]. Site Visited [Apr. 1, 2018]. Available from Internet URL: https://hydrationanywhere.com/easy-guide-to-hydro-flask-lids/.

Hydro Flask Lid: Announced Apr. 1, 2016 [online]. Site Visited [Apr. 16, 2018]. Available from Internet URL: https://www .hydroflask.com/hydro-fli p/color, black,a, 92,o,20.

Non-Final Office Action, dated Apr. 20, 2018, received in Design U.S. Appl. No. 29/599,788.

Information Disclosure Statement Transmittal filed herewith.

Commuter Lid: Site Visited [Aug. 12, 2019] Online. Available from Internet URL: https://www.swellbottle.com/products/get-inspired/on-the-go-essentials/commuter-lid/.

Icon Vacuum Travel Tumbler Lid: Site Visited [Aug. 12, 2019] Online. Available from Internet URL: https://www.timolino.com/product/icon-vacuum-travel-tumbler-flip-top-lid/.

Notice of Allowance, dated Aug. 28, 2019, received in U.S. Appl. No. 29/692,941.

* cited by examiner

BEVERAGE CONTAINER LID WITH ADJUSTABLE FLOW RATE

BACKGROUND OF THE INVENTION

Field of the Invention

The present invention is directed generally to beverage container lids.

Description of the Related Art

Beverage containers, particularly those that are vacuum-insulated, are capable of holding liquids having a wide range of temperatures and maintaining the temperatures of those liquids for a long time. How quickly a user prefers to drink a liquid is a matter of subjective preference. Research has shown that users prefer to drink or sip hot liquids (e.g., liquids having a temperature greater than room temperature, liquids having a temperature within a range of about 120 degrees Fahrenheit to about 160 degrees Fahrenheit, and the like) at a relatively slow flow rate (e.g., about 10 milliliters per second ("mL/s") to about 20 mL/s). Research has also shown that users prefer to drink room-temperature liquids or cold liquids (e.g., liquids having a temperature less than room temperature, liquids having a temperature within a range of about 32 degrees Fahrenheit to about 72 degrees Fahrenheit, and the like) at a relatively fast flow rate (e.g., about 55 mL/s to about 80 mL/s). Thus, when the user drinks a liquid directly from a beverage container, the user may determine a desired flow (or drinking) rate at least in part based on the liquid's temperature and at least in part based on the subjective preference of the user. Thus, a need exists for lids configured to allow a liquid to flow therethrough at different flow rates. The present application provides these and other advantages as will be apparent from the following detailed description and accompanying figures.

BRIEF DESCRIPTION OF THE SEVERAL VIEWS OF THE DRAWING(S)

Like reference numerals have been used in the figures to identify like components.

DETAILED DESCRIPTION OF THE INVENTION

Figure 1:
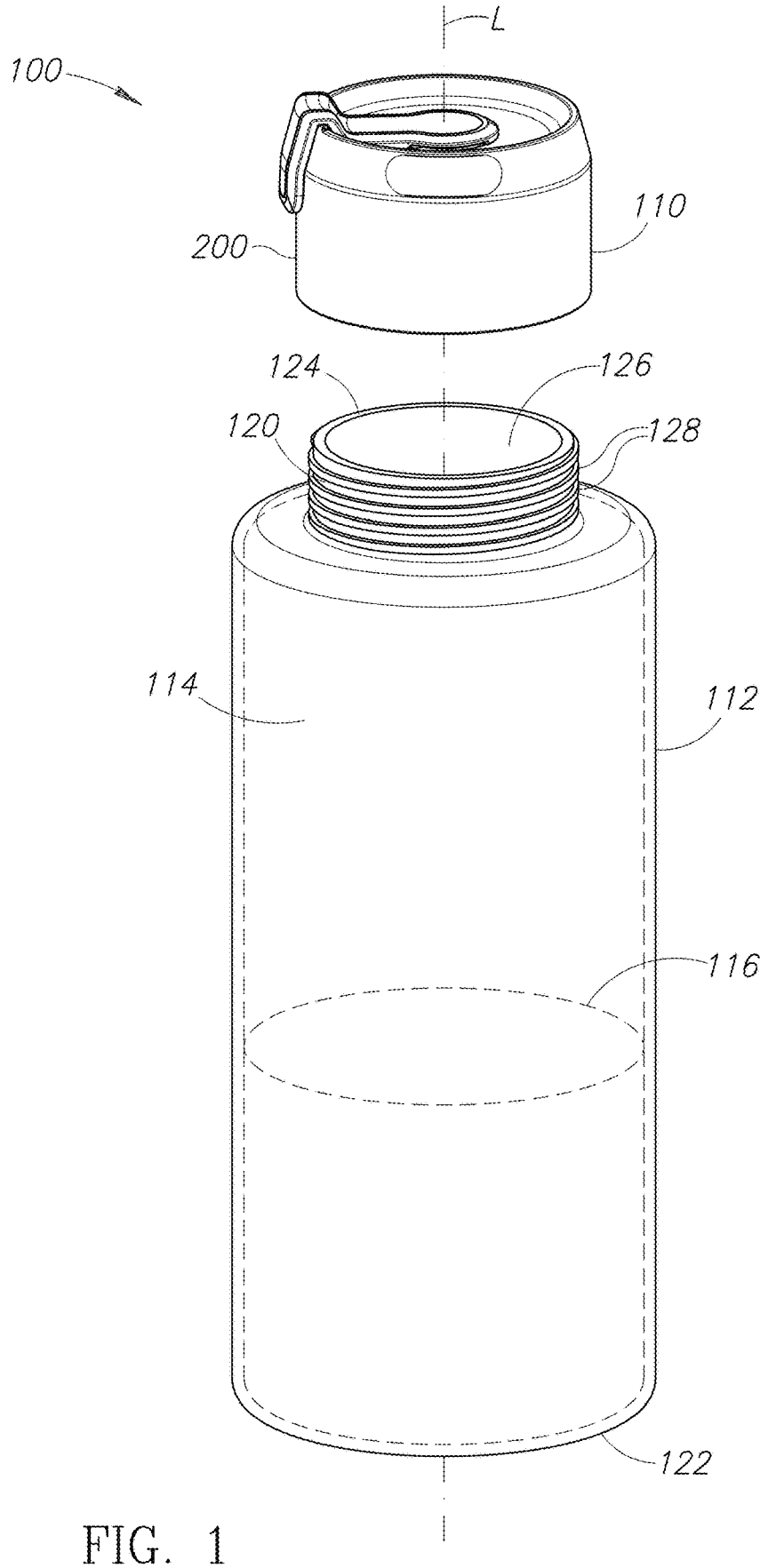
FIG. 1 is a partially exploded side perspective view of a beverage container with a lid assembly.

FIG. 1 depicts a beverage container 100 (e.g., a thermos) configured to be drank directly from by a user. The beverage container 100 extends along a longitudinal axis "L." The beverage container 100 includes a lid assembly 110 removably attachable to a liquid tight generally cup-shaped vessel 112. The vessel 112 defines a fluid tight hollow interior 114 configured to house a beverage or liquid 116. The vessel 112 has an open upper portion 120 opposite a closed base portion 122. The open upper portion 120 includes an upper edge 124 defining an opening 126 into the hollow interior 114. The liquid 116 may be poured into the hollow interior 114 of the vessel 112 via the opening 126. The lid assembly 110 is removably couplable to the open upper portion 120 to close the opening 126. In the embodiment illustrated, the open upper portion 120 has outside threads 128 configured to thread into the lid assembly 110 (e.g., by rotating the lid assembly 110 about the longitudinal axis "L" with respect to the vessel 112). By way of non-limiting examples, the vessel 112 may be implemented as a Stanley Go series bottle, a Stanley UH series bottle, a FIJI bottle, a TONGA bottle, a WAKE bottle, a BLOCK bottle, a NANTUCKET bottle, a VINEYARD bottle, and the like.

Figure 2:
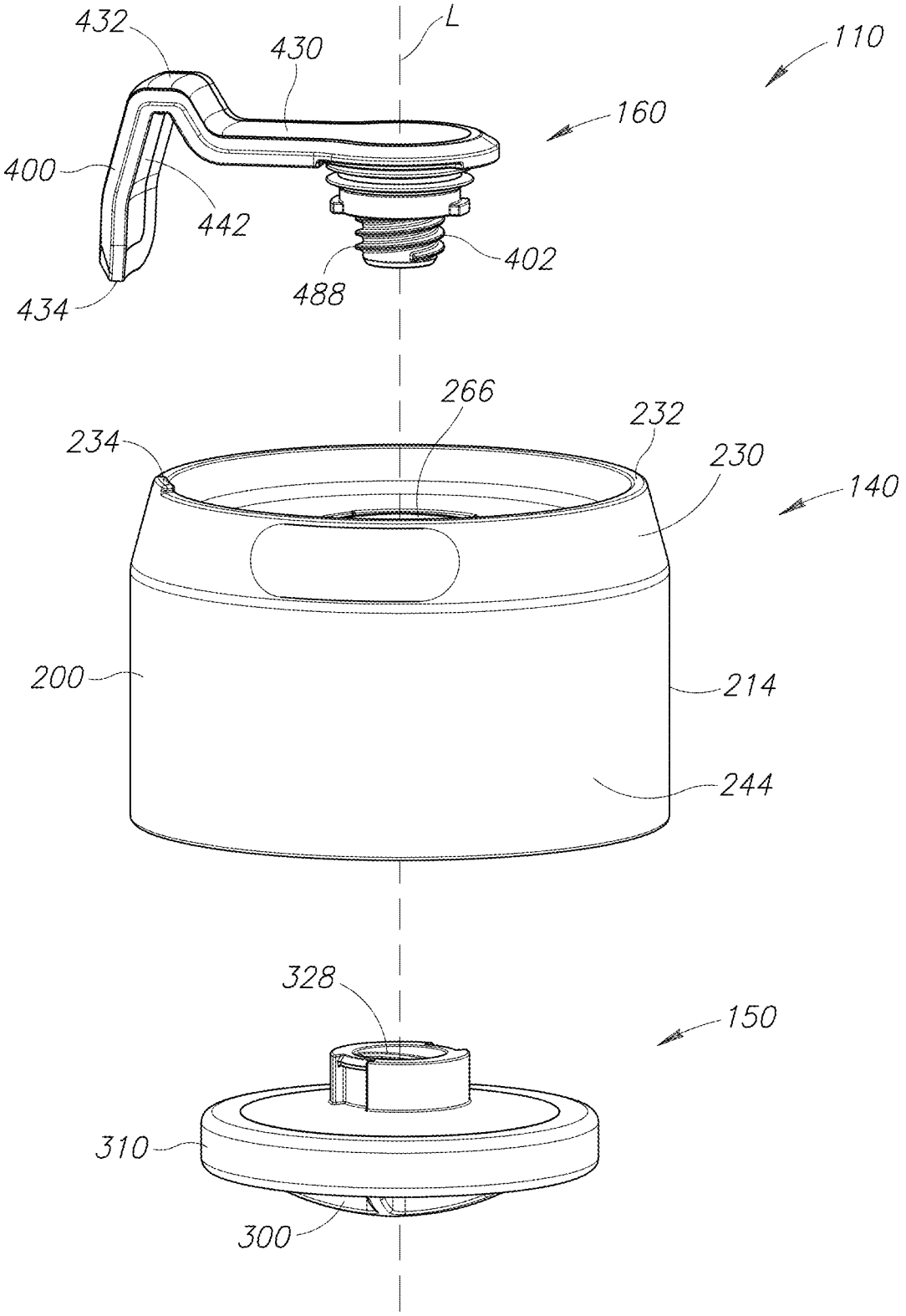
FIG. 2 is a partially exploded side perspective view of the lid assembly.

The lid assembly 110 is leak-proof and has an adjustable flow rate for use with the liquid 116 having a temperature ranging from hot to cold. The lid assembly 110 is configured to allow the user to select the flow rate of the liquid 116 as it passes therethrough. Referring to FIG. 2, the lid assembly 110 includes a lid body assembly 140, a stopper assembly 150, and a flow control or lever assembly 160. The user selects the flow rate by operating the lever assembly 160, which is positioned on top of and extends into the lid body assembly 140. Inside the lid body assembly 140, the lever assembly 160 may be directly connected to the stopper assembly 150. When the stopper and lever assemblies 150 and 160 are directly connected together (as shown in FIGS. 11B, 12B, and 13B), operating the lever assembly 160 moves the stopper assembly 150 relative to the lid body assembly 140.

The lid assembly 110 may be configured to operate in four modes of operation. Referring to FIG. 11B, the stopper assembly 150 may be positioned by the lever assembly 160 to completely close the lid body assembly 140 thereby configuring the lid assembly 110 to operate in a first (closed) mode of operation. In the first (closed) mode, the lid assembly 110 is leak-proof and prevents the liquid 116 (see FIG. 1) from flowing therethrough. Referring to FIG. 12B, the stopper assembly 150 may be positioned by the lever assembly 160 to open the lid body assembly 140 by a first (hot) amount thereby configuring the lid assembly 110 to operate in a second (hot) mode of operation. In the second (hot) mode, the lid assembly 110 allows the liquid 116 (see FIG. 1) to flow therethrough with a first (hot) flow rate (e.g., about 20 mL/s to about 50 mL/s). Referring to FIG. 13B, the stopper assembly 150 may be positioned by the lever assembly 160 to open the lid body assembly 140 by a second (cold) amount thereby configuring the lid assembly 110 to operate in a third (cold) mode of operation. In the third (cold) mode, the lid assembly 110 allows the liquid 116 (see FIG. 1) to flow therethrough with a second (cold) flow rate (e.g., about 60 mL/s). The second (cold) flow rate is faster than the first (hot) flow rate. Referring to FIG. 14B, the stopper assembly 150 may be disengaged from the lever assembly 160 thereby configuring the lid assembly 110 to operate in a fourth (cleaning) mode of operation. In the fourth (cleaning) mode, the stopper assembly 150 and the lever assembly 160 may be removed from the lid body assembly 140 (in directions identified by arrows "A1" and "A2," respectively) for cleaning. Thus, the lid assembly 110 may be disassembled for easy cleaning.

Lid Body Assembly

Figure 3:
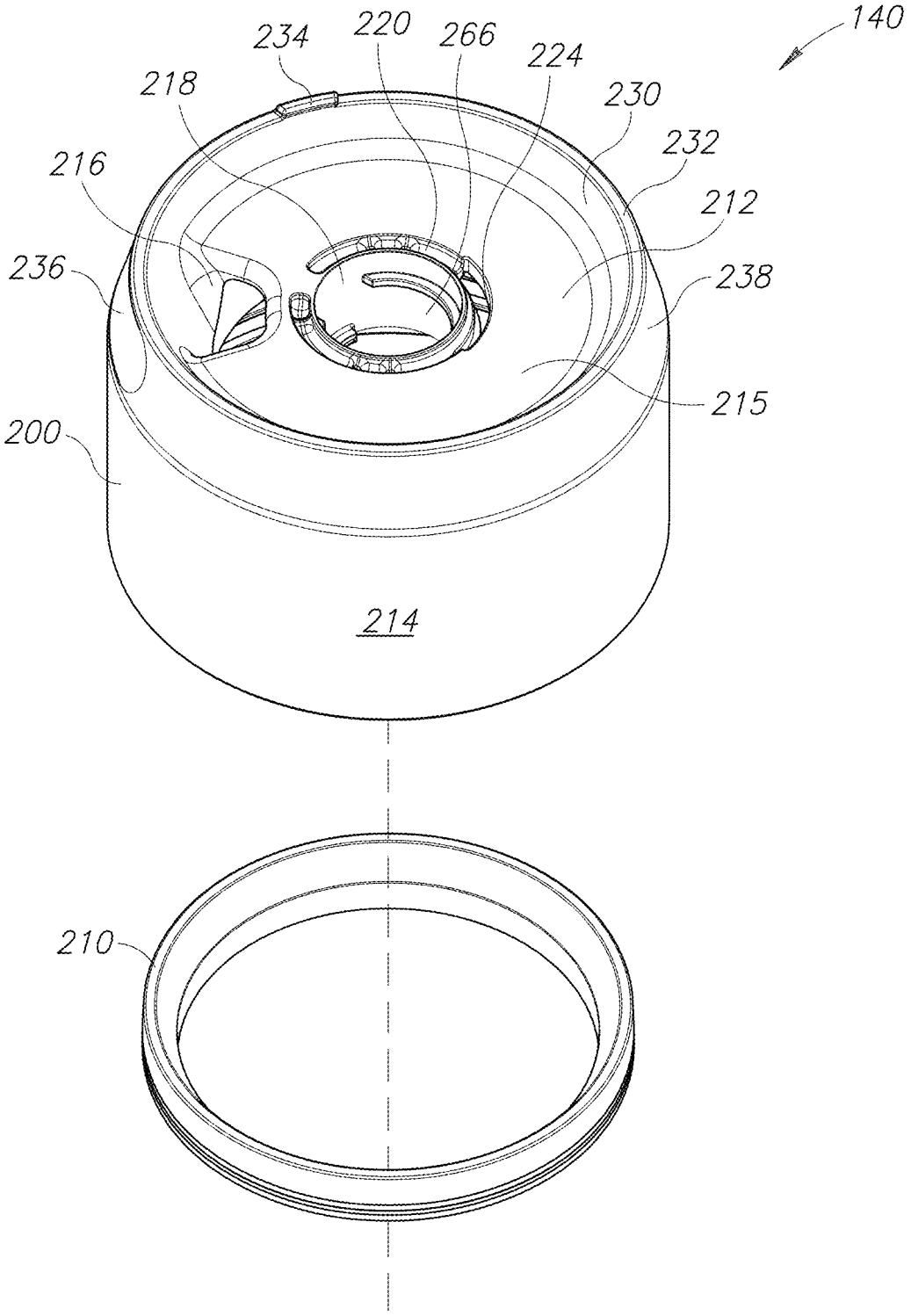
FIG. 3 is an exploded top perspective view of a lid body assembly of the lid assembly.

Referring to FIG. 3, the lid body assembly 140 includes a lid body member 200 and a lid body seal 210. By way of a non-limiting example, the lid body member 200 may be constructed from an amorphous copolyester (e.g., Eastman Tritan™ TX 1001), a thermoplastic polymer (e.g., polypropylene), and the like. The lid body member 200 has an upper transverse generally circularly shaped platform portion 212 surrounded circumferentially by a downwardly extending sidewall 214. The platform portion 212 has an upper surface 215. Spaced apart through-holes or apertures 216 and 218 extend through the platform portion 212 from the upper surface 215. The apertures 216 and 218 may be characterized as being a pouring aperture and a pivot aperture, respectively.

Figure 5:
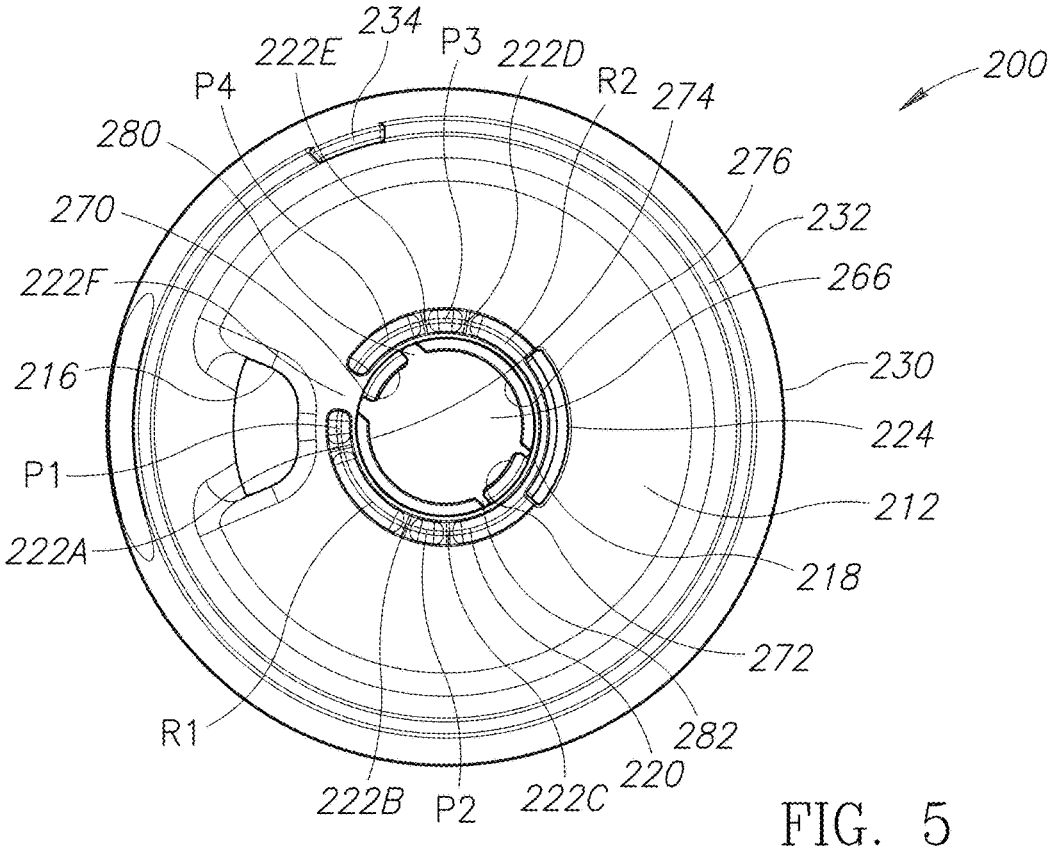
FIG. 5 is a top view of a lid body member of the lid body assembly.

A groove 220 is formed in the upper surface 215 of the platform portion 212 and at least partially extends circumferentially about the pivot aperture 218. The groove 220 is spaced radially outward from the pivot aperture 218. Referring to FIG. 5, in the embodiment illustrated, the platform portion 212 includes stop walls 222A-222F that divide the groove 220 into stop positions "P1" to "P4" and regions "R1" and "R2." The first (closed) stop position "P1" is located within the groove 220 between the stop walls 222F and 222A. The second (hot open) stop position "P2" is located within the groove 220 between the stop walls 222B and 222C. The third (cold open) stop position "P3" is located within the groove 220 between the stop walls 222D and 222E. The fourth (cleaning) stop position "P4" is located within the groove 220 between the stop walls 222E and 222F. The first region "R1" is positioned between the first (closed) stop position "P1" and the second (hot open) stop position "P2." The second region "R2" is positioned between the second (hot open) stop position "P2" and the third (cold open) stop position "P3." Optionally, a circular arc shaped through-hole or vent 224 may be formed in or alongside the groove 220. In the embodiment illustrated, the vent 224 extends at least partway into the second region "R2." However, this is not a requirement.

Referring to FIG. 3, the platform portion 212 is surrounded circumferentially by an upwardly extending and tapered lip 230 having an upper edge 232. A cleaning mode stop 234 extends upwardly from the upper edge 232. Optionally, the tapered lip 230 may have a recess 236 formed in its outer surface 238 and aligned with the pouring aperture 216.

Figure 4:
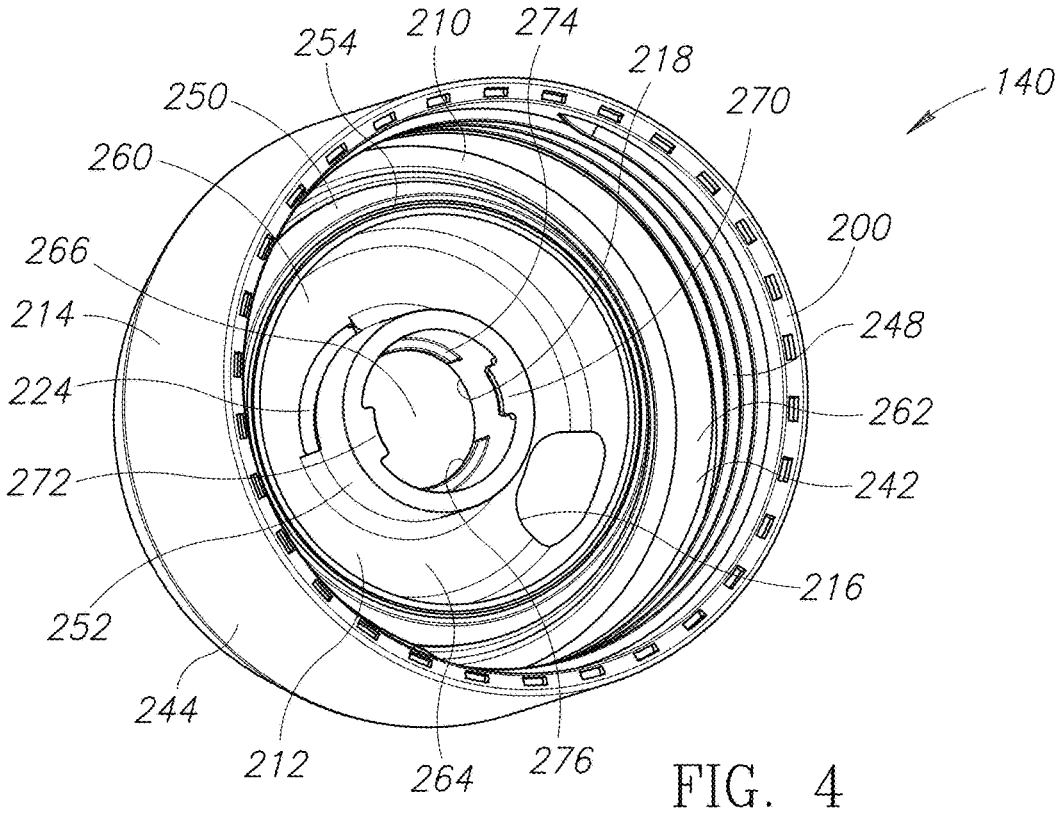
FIG. 4 is a bottom perspective view of the lid body assembly.

Referring to FIG. 4, the sidewall 214 has an inwardly facing surface 242 and an opposite outwardly facing surface 244. The inwardly facing surface 242 has inside threads 248 formed therein configured to engage and mate with the outside threads 128 (see FIG. 1) of the vessel 112 (see FIG. 1). Thus, the user may selectively thread the lid body assembly 140 onto and off the vessel 112 (see FIG. 1). When the inside threads 248 are fully engaged with the outside threads 128 (see FIG. 1), a liquid tight seal is formed therebetween.

A pair of spaced apart concentric inner walls 250 and 252 extend downwardly from the platform portion 212 inside a cavity 260 defined by the platform portion 212 and the sidewall 214. Optionally, the inner wall 250 may have a downwardly extending ring-shaped projection 254. A downwardly opening annular or ring-shaped chamber 262 is defined between the inner wall 250 and the sidewall 214.

A downwardly opening annular or ring-shaped fluid chamber 264 is defined between the inner walls 250 and 252. The vent 224 is positioned between the inner walls 250 and 252 and opens into the fluid chamber 264. The inner wall 252 defines a through-channel 266 in fluid communication with the pivot aperture 218. The through-channel 266 extends along the longitudinal axis "L" (see FIGS. 1 and 2) and may be centered on the longitudinal axis "L." Stops 270 and 272 extend inwardly from the inner wall 252 into the through-channel 266. Ledges 274 and 276 extend into the through-channel 266 from the inner wall 252 (see FIG. 4). The ledges 274 and 276 are aligned with one another along the longitudinal axis "L" (see FIGS. 1 and 2) across the through-channel 266. Referring to FIG. 5, gaps 280 and 282 are defined along the inner wall 252 (see FIG. 4) between the ledges 274 and 276. The gaps 280 and 282 are vertically aligned with the stops 270 and 272, respectively. In the embodiment illustrated, the gap 280 is larger than the gap 282.

Referring to FIG. 3, the lid body seal 210 may be generally ring-shaped and configured to form a fluid-tight seal between the lid body member 200 and the vessel 112 (see FIG. 1). Referring to FIG. 4, the ring-shaped chamber 262 is configured to receive and retain the lid body seal 210. The ring-shaped chamber 262 positions the lid body seal 210 to be pressed upon by the upper edge 124 (see FIG. 1) of the vessel 112 (see FIG. 1) when the inside threads 248 and the outside threads 128 (see FIG. 1) are threaded together. Thus, a fluid tight seal may be formed between the upper edge 124 (see FIG. 1) of the vessel 112 (see FIG. 1) and the lid body seal 210. The lid body seal 210 may be constructed from a flexible and compressible material. By way of a non-limiting example, the lid body seal 210 may be constructed from silicone.

Stopper Assembly

Referring to FIG. 2, the stopper assembly 150 includes a stopper member 300 and a stopper seal 310. The stopper assembly 150 is configured to be snap fit into the lid body member 200 and to threadedly engage the lever assembly 160 inside the lid body member 200. The stopper assembly 150 is movable with respect to the lid body assembly 140 between at least four different positions, which will be referred to as a closed position (see FIG. 11B), a hot open position (see FIG. 12B), a cold open position (see FIG. 13B), and a pre-cleaning position (see FIG. 14B).

Figure 6:
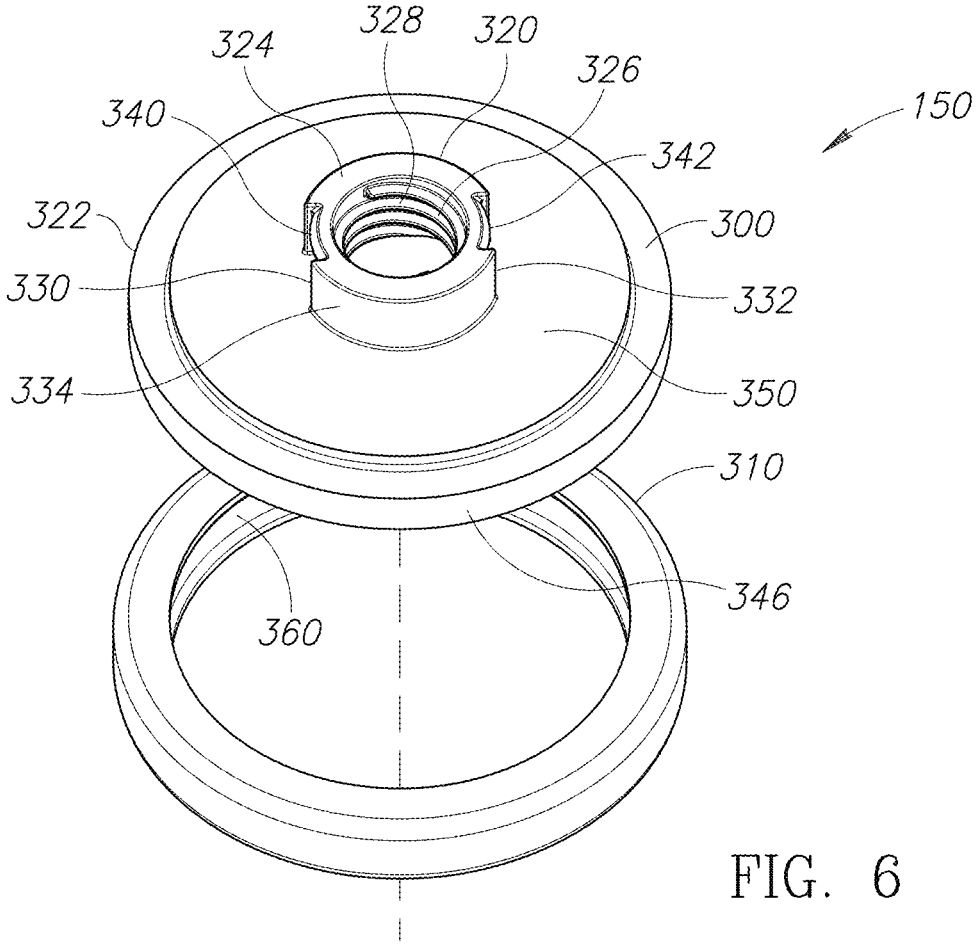
FIG. 6 is an exploded top perspective view of a stopper assembly of the lid assembly.

By way of a non-limiting example, the stopper member 300 may be constructed from acrylonitrile butadiene styrene ("ABS"), an amorphous copolyester (e.g., Eastman Tritan™ TX 2001), and the like. Referring to FIG. 6, the stopper member 300 has an upper anchor portion 320 and a lower stopper portion 322. The upper anchor portion 320 is configured to be received inside the through-channel 266 (see FIGS. 3-5). The upper anchor portion 320 has an upwardly facing end surface 324. A channel 326 extends downwardly into the upper anchor portion 320 from the end surface 324. The channel 326 includes inside threads 328. The upper anchor portion 320 has a pair of downwardly extending grooves or tracks 330 and 332 formed along its outer surface 334. The tracks 330 and 332 are configured to receive the stops 270 and 272 (see FIGS. 4 and 5), respectively, which prevent the stopper member 300 from spinning with respect to the lid body assembly 140 (see FIGS. 2-4, 11B, 12B, 13B, and 14B). Tabs 340 and 342 are formed in the tracks 330 and 332, respectively. The tabs 340 and 342 are configured to travel over the stops 270 and 272 (see FIGS. 4 and 5), respectively, when the stopper assembly 150 is snap fit into the lid body member 200 (see FIGS. 1-5 and 11A-14B). The tabs 340 and 342 retain the stopper assembly 150 inside the lid body member 200 (see FIGS. 1-5 and 11A-14B). The stops 270 and 272 (see FIGS. 4 and 5) may travel (e.g., vertically) within the tracks 330 and 332, respectively, between the tabs 340 and 342, respectively, and the lower stopper portion 322.

The lower stopper portion 322 is configured to be received inside the cavity 260 (see FIG. 4) but is too large to enter the fluid chamber 264 (see FIGS. 4, 11B, 12B, 13B, and 14B). The lower stopper portion 322 has an outer peripheral portion 346. The stopper seal 310 is positioned along and extends about the outer peripheral portion 346. Referring to FIG. 11B, when the stopper assembly 150 is in the closed position, the outer peripheral portion 346 (see FIG. 6) positions the stopper seal 310 against the inner wall 250 (e.g., the ring-shaped projection 254), which forms a fluid tight seal therebetween.

Referring to FIG. 12B, when the stopper assembly 150 is in the hot open position, the stopper seal 310 is spaced apart from the inner wall 250 (e.g., the ring-shaped projection 254) by a first distance (e.g., about 0.88 mm). The liquid 116 (see FIG. 1) may travel through a first gap "G1" (defined between the stopper seal 310 and the inner wall 250), the enter the fluid chamber 264, and exit the fluid chamber 264 at the first (hot) flow rate through the pouring aperture 216.

Referring to FIG. 13B, when the stopper assembly 150 is in the hot open position, the stopper seal 310 is spaced apart from the inner wall 250 (e.g., the ring-shaped projection 254) by a second distance (e.g., about 3 mm). The liquid 116 (see FIG. 1) may travel through a second gap "G2" (defined between the stopper seal 310 and the inner wall 250), enter the fluid chamber 264, and exit the fluid chamber 264 at the second (cold) flow rate through the pouring aperture 216.

Referring to FIG. 14B, when the stopper assembly 150 is in the pre-cleaning position, the stopper seal 310 is spaced apart from the inner wall 250 (e.g., the ring-shaped projection 254) by a third distance (e.g., about 3.55 mm). Optionally, the liquid 116 (see FIG. 1) may travel through a third gap "G3" (defined between the stopper seal 310 and the inner wall 250), enter the fluid chamber 264, and exit the fluid chamber 264 at a third (maximum) flow rate through the pouring aperture 216. In the pre-cleaning position, the stopper member 300 is detached from the lever assembly 160. Referring to FIG. 6, the upper anchor portion 320 of the stopper member 300 is maintained inside the through-channel 266 (see FIGS. 3-5) by the tabs 340 and 342, which rest upon the stops 270 and 272 (see FIGS. 4 and 5), respectively. Referring to FIG. 14B, the stopper assembly 150 may be separated from the lid body assembly 140 by pulling (e.g., in the direction identified by the arrow "A1") on the stopper assembly 150 with sufficient force to pull the tabs 340 and 342 over the stops 270 and 272 (see FIGS. 4 and 5), respectively, and unsnap the stopper assembly 150 from the lid body member 200.

Figure 7:
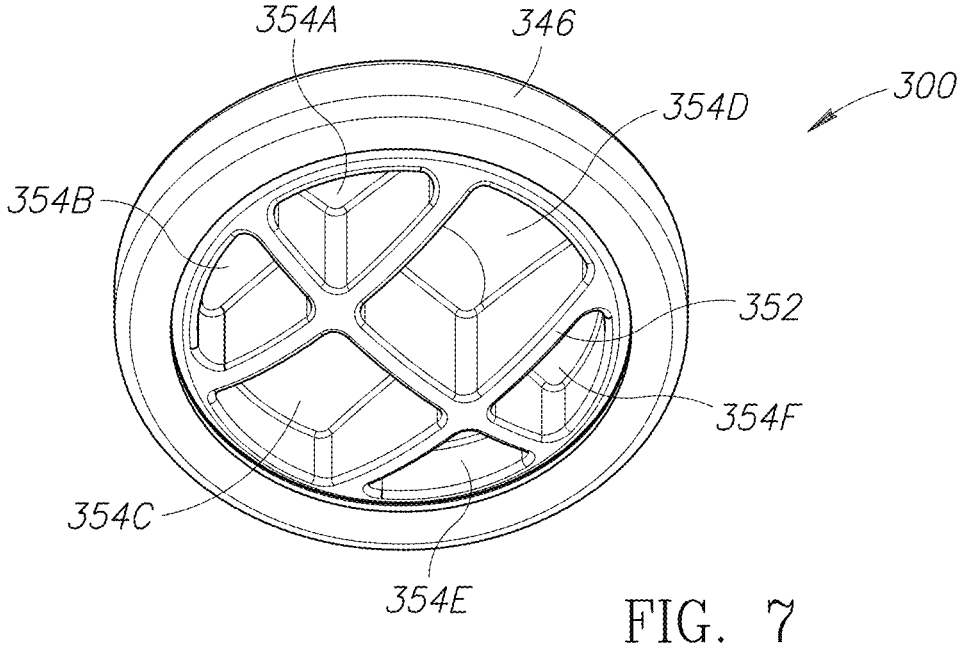
FIG. 7 is a bottom perspective view of a stopper member of the stopper assembly.

Referring to FIG. 6, the lower stopper portion 322 has a curved or domed upper surface 350 that facilitates draining when the stopper assembly 150 is in the hot open position (see FIG. 12B), the cold open position (see FIG. 13B), or the pre-cleaning position (see FIG. 14B). Referring to FIG. 7, in the embodiment illustrated, the lower stopper portion 322 has a curved or domed lower surface 352 into which one or more recesses 354A-354F may be formed. The recesses 354A-354F may define one or more ribs in the lower surface 352. However, this is not a requirement.

Referring to FIG. 6, the stopper seal 310 may be generally ring-shaped with a generally U-shaped cross-sectional shape. In the embodiment illustrated, the stopper seal 310 has an annular inside opening 360 configured to receive and retain the outer peripheral portion 346. The stopper seal 310 may be constructed from a flexible and compressible material. By way of a non-limiting example, the stopper seal 310 may be constructed from silicone.

Lever Assembly

Figure 8:
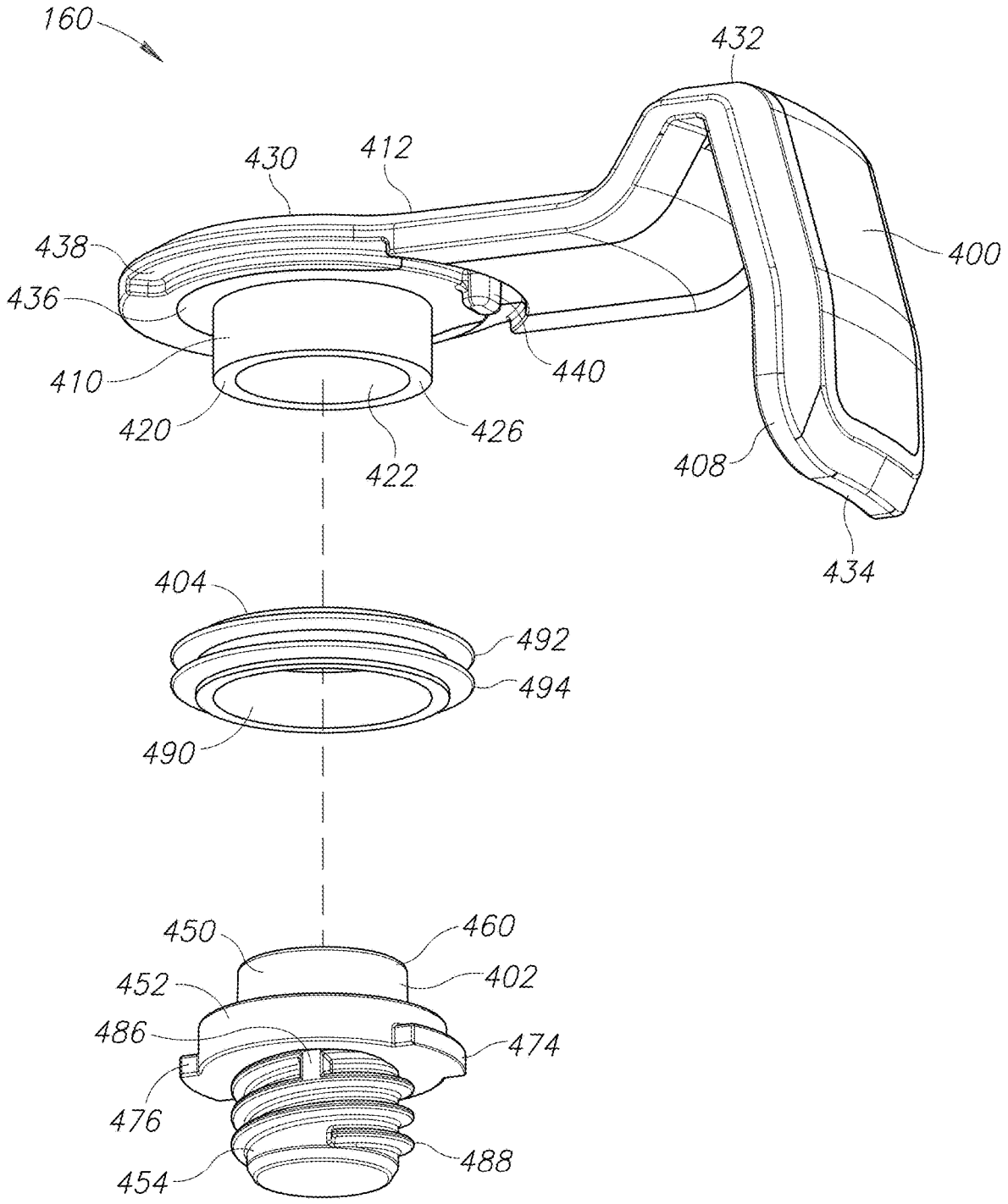
FIG. 8 is an exploded side perspective view of a lever assembly of the lid assembly.

Referring to FIG. 8, the lever assembly 160 includes a flow control member (e.g., a lever member 400), a threaded member 402, and a lever seal 404. By way of a non-limiting example, the lever member 400 may be constructed from plastic, such as a thermoplastic polymer (e.g., polypropylene). At least a portion of the lever member 400 may be over-molded with a flexible and/or compressible material. For example, the lever member 400 may have a peripheral edge 406 (see FIGS. 11B, 12B, 13B, and 14B) which is over-molded with the flexible and/or compressible material 408. By way of a non-limiting example, the material 408 may be a plastic material, such as one or more thermoplastic elastomers ("TPE").

Figure 9:
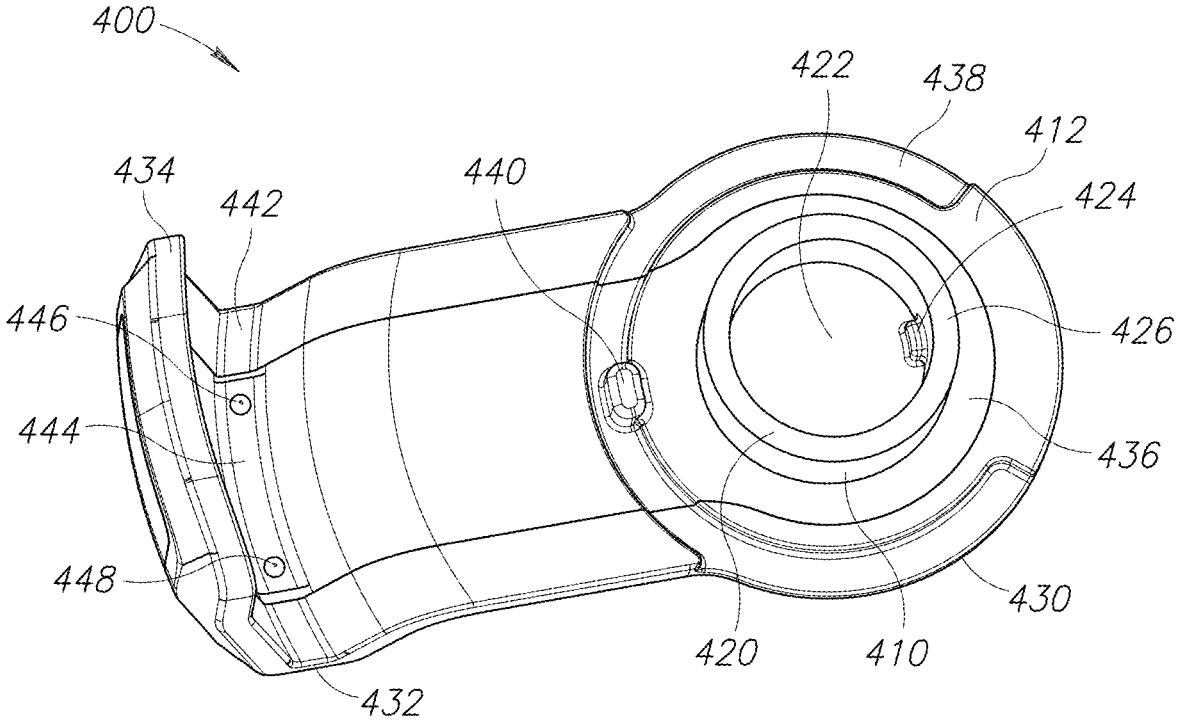
FIG. 9 is a bottom perspective view of a lever member of the lever assembly.

The lever member 400 has a pivot portion 410 that extends downwardly from a lever portion 412. The pivot portion 410 is configured to be received inside the through-channel 266 (see FIGS. 3-5) and rotate therein about the longitudinal axis "L" (see FIGS. 1 and 2). The pivot portion 410 has a downwardly extending sidewall 420 with a generally circular cross-sectional shape. The sidewall 420 defines a hollow interior 422. Referring to FIG. 9, inside the hollow interior 422, a key projection 424 extends downwardly from the lever portion 412. In the embodiment illustrated, the key projection 424 extends along a portion of the sidewall 420. The sidewall 420 has a lower downwardly facing edge 426 opposite the lever portion 412.

The lever portion 412 has a connector portion 430 connected to a grip portion 432. The connector portion 430 has an underside 436 configured to be positioned alongside the upper surface 215 (see FIG. 3) of the platform portion 212 (see FIGS. 3-5) of the lid body member 200 (see FIGS. 1-5 and 11A-14B). The connector portion 430 may be substantially planar. Referring to FIG. 2, the grip portion 432 is configured to traverse the tapered lip 230 of the lid body member 200 and position its free distal end portion 434 against the outwardly facing surface 244 of the sidewall 214 of the lid body member 200. Referring to FIG. 9, the pivot portion 410 is connected to the underside 436 of the connector portion 430. In the embodiment illustrated, the connector portion 430 includes a semi-circular recess 438 formed in its underside 436 along its periphery.

The connector portion 430 has a downwardly extending projection 440 spaced apart from the pivot portion 410. The projection 440 may be aligned with the key projection 424. In the embodiment illustrated, a portion of the projection 440 is positioned in the recess 438. The projection 440 is configured to be received inside the groove 220 (see FIGS. 3, 5, 11B and 12B) and to slide therein. The projection 440 is configured to traverse the stop walls 222A-222E (see FIG. 5) one at a time as the pivot portion 410 rotates within the through-channel 266 (see FIGS. 3-5). The projection 440 is sized to rest and be releasably retained inside each of the stop positions "P1"-"P4" (see FIG. 5) and the regions "R1" and "R2" (see FIG. 5) until a sufficient force is applied by the user to move the lever assembly 160 causing the projection 440 to slide over and traverse an adjacent one of the stop walls 222A-222E.

The connector portion 430 is configured to cover or hide the vent 224 (see FIGS. 3-5, 12B, and 13B) from the user's view. The projection 440 may be configured to be received inside the vent 224 (see FIGS. 3-5, 12B, and 13B). However, this is not a requirement.

Referring to FIG. 2, the grip portion 432 has an underside 442 that faces the tapered lip 230 of the lid body member 200 and the outwardly facing surface 244 of the sidewall 214 of the lid body member 200. A projection 444 (see FIG. 9) extends downwardly from the underside 442 and is positioned on the upper edge 232 of the tapered lip 230. The projection 444 (see FIG. 9) is configured to slide along the upper edge 232 when the pivot portion 410 (see FIGS. 8 and 9) is rotated within the through-channel 266 to thereby position the grip portion 432 with respect to the lid body member 200. The cleaning mode stop 234 is configured to abut the grip portion 432 (e.g., the projection 444 illustrated in FIG. 9) and limit the motion of the lever member 400 with respect to the lid body member 200. In the embodiment illustrated, referring to FIG. 9, projections 446 and 448 extend downwardly from the projection 444 to contact the upper edge 232 (see FIGS. 2, 3, and 5). However, this is not a requirement.

Referring to FIG. 8, the threaded member 402 has an upper portion 450, an intermediate portion 452, and a lower threaded portion 454. By way of a non-limiting example, the threaded member 402 may be constructed from plastic, such as a thermoplastic polymer (e.g., polypropylene).

Figure 10:
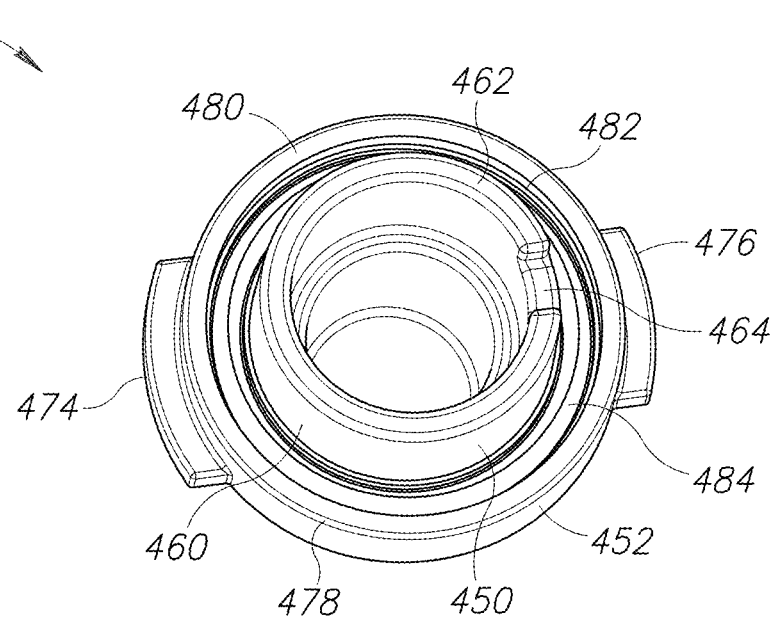
FIG. 10 is a top perspective view of a threaded member of the lever assembly.

Referring to FIG. 10, the upper portion 450 includes an outer sidewall 460 having an upper edge 462 in which a keyway 464 is formed. Referring to FIG. 8, the outer sidewall 460 is configured to be received inside the interior 422 defined by the sidewall 420 with the keyway 464 (see FIG. 10) receiving the key projection 424 (see FIG. 9). By way of a non-limiting example, the outer sidewall 460 may be press fit into the interior 422 defined by the sidewall 420. Referring to FIG. 10, engagement between the keyway 464 and the key projection 424 (see FIG. 9) prevents the threaded member 402 from rotating with respect to the lever member 400 (see FIGS. 2, 8, 9, and 11A-14B). Thus, referring to FIG. 8, the threaded member 402 and the lever member 400 will rotate together as a unit when the lever member 400 is rotated within the through-channel 266 (see FIGS. 3-5). Referring to FIG. 2, a user may rotate the lever member 400 manually by grasping the grip portion 432 and sliding it along the tapered lip 230 (as shown in FIGS. 11A, 12A, 13A, and 14A).

The intermediate portion 452 has radially outwardly extending projections 474 and 476. When the lever assembly 160 is assembled, the projection 474 extends under the connector portion 430 toward the grip portion 432 and the projection 476 extends under the connector portion 430 away from the grip portion 432. Referring to FIG. 10, engagement between the keyway 464 and the key projection 424 (see FIG. 9) ensures that the projections 474 and 476 are properly oriented with respect to the lever member 400 (see FIGS. 2, 8, 9, and 11A-14B). Referring to FIG. 8, the projections 474 and 476 may both be aligned with the projection 440.

The projections 474 and 476 are configured to abut and slide along the undersides of the ledges 274 and 276 (see FIGS. 4 and 5) of the lid body member 200 (see FIGS. 1-5 and 11A-14B). Referring to FIG. 10, in the embodiment illustrated, the projection 474 extends farther around the intermediate portion 452 than the projection 476. The projection 474 is configured to slide vertically within the gap 280 (see FIG. 5) but is too large to slide vertically within the gap 282 (see FIG. 5). Thus, the threaded member 402 may be removed from the through-channel 266 through the pivot aperture 218 (in the direction identified by the arrow "A2" in FIG. 14B) only when the projections 474 and 476 are aligned with the gaps 280 and 282 (see FIG. 5), respectively. When the projections 474 and 476 are abutting the undersides of the ledges 274 and 276 (see FIGS. 4 and 5), respectively, a portion 478 of the intermediate portion 452 positioned above the projections 474 and 476 may extend upwardly along the longitudinal axis "L" (see FIGS. 1 and 2) and be positioned between the ledges 274 and 276.

Referring to FIG. 8, the intermediate portion 452 is sized such that its upwardly facing outer surface 480 (see FIG. 10) abuts the downwardly facing edge 426 of the sidewall 420 and does not pass into the interior 422 defined by the sidewall 420. Referring to FIG. 10, in the embodiment illustrated, the upwardly facing outer surface 480 may have an upwardly opening ring-shaped channel 482 formed therein. A ring-shaped projection 484 may extend upwardly from the ring-shaped channel 482. The ring-shaped projection 484 may a generally inverted V cross-sectional shape. Referring to FIG. 8, the ring-shaped projection 484 (see FIG. 10) engages the downwardly facing edge 426 of the sidewall 420. In some embodiments, the sidewall 420 may have a cross-sectional profile (e.g., an inverted V-shaped cross-sectional profile) configured to receive and mate with the ring-shaped projection 484 (see FIG. 10). However, this is not a requirement.

Referring to FIG. 8, the lower threaded portion 454 has outside threads 488 configured to thread into the inside threads 328 (see FIGS. 2, 6, 11B, 12B, 13B, and 14B) of the stopper member 300 (see FIGS. 2, 6, 7, 11B, 12B, 13B, and 14B). The lower threaded portion 454 may include a thread stop 486 configured to limit how far the outside threads 488 may be threaded into the inside threads 328 (see FIGS. 2, 6, 11B, 12B, 13B, and 14B). The outside threads 488 may be implemented as double-start threads. By way of a non-limiting example, the outside threads 488 may have a thread pitch of about 4 mm. The intermediate portion 452 is sized to abut the end surface 324 (see FIG. 6) of the stopper member 300 (see FIGS. 2, 6, 7, 11B, 12B, 13B, and 14B) and not pass into the downwardly extending channel 326 (see FIG. 6). Thus, the threaded member 402 is removably couplable to the stopper member 300 (see FIGS. 2, 6, 7, 11B, 12B, 13B, and 14B).

Referring to FIG. 8, the lever seal 404 is generally ring-shaped with a central through-channel 490 formed therein. The through-channel 490 is configured to receive the sidewall 420 of the lever member 400. The lever seal 404 forms a fluid-tight seal between the pivot portion 410 of the lever member 400 and the inner wall 252 (see FIG. 4) of the lid body member 200 (see FIGS. 1-5 and 11A-14B). The lever seal 404 is configured to extend from the underside 436 (see FIGS. 8 and 9) of the connector portion 430 to the upwardly facing outer surface 480 (see FIG. 9) of the intermediate portion 452 of the threaded member 402. In the embodiment illustrated, the lever seal 404 includes radially outwardly extending projections 492 and 494 configured to abut the inner wall 252 of the lid body member 200 and form the fluid-tight seal therewith. By way of a non-limiting example, the lever seal 404 may be constructed from silicone.

While the flow control member has been described and illustrated as being the lever member 400, in alternate embodiments, the flow control member may be implemented as a dial, knob (e.g., like a volume knob), or similar rotatable structure. In such embodiments, the projection 440 may be omitted and a rotational position of the dial (or knob) with respect to the lid body member 200 may determine the position of the stopper assembly 150 with respect to the lid body member 200. For example, the dial (or knob) may be rotated to a first position that positions the stopper member 300 to press the stopper seal 310 against the inner wall 250 and form a fluid-tight seal therewith. In other words, the liquid 116 (see FIG. 1) is prevented from flowing between the inner wall 250 and the stopper member 300. The dial (or knob) may be rotated to a second position that spaces the stopper member 300 and the stopper seal 310 apart from the inner wall 250 by the first distance (e.g., about 0.88 mm) and defines the first gap "G1" therebetween. The first gap "G1" allows the liquid 116 (see FIG. 1) to flow therethrough at the first (hot) flow rate (e.g., about 20 mL/s to about 50 mL/s). The dial (or knob) may be rotated to a third position that spaces the stopper member 300 and the stopper seal 310 apart from the inner wall 250 by the second distance (e.g., about 3 mm) and defines the second gap "G2" therebetween. The second gap "G2" is larger than the first gap "G1" (see FIG. 11B) and allows the liquid 116 (see FIG. 1) to flow therethrough at the second (cold) flow rate (e.g., about 60 mL/s). Further, the dial (or knob) may be positioned in between the first and second positions to obtain a flow rate that is slower than the first (hot) flow rate. The dial (or knob) may be positioned in between the second and third positions to obtain a flow rate that is in between the first and second flow rates. Additionally, the dial (or knob) may be positioned beyond the third position to obtain a flow rate that is faster than the second (cold) flow rate. Optionally, the dial (or knob) may be rotated to a fourth position that configures the lid assembly 110 to operate in the fourth (cleaning) mode of operation.

Operation

Figure 11A:
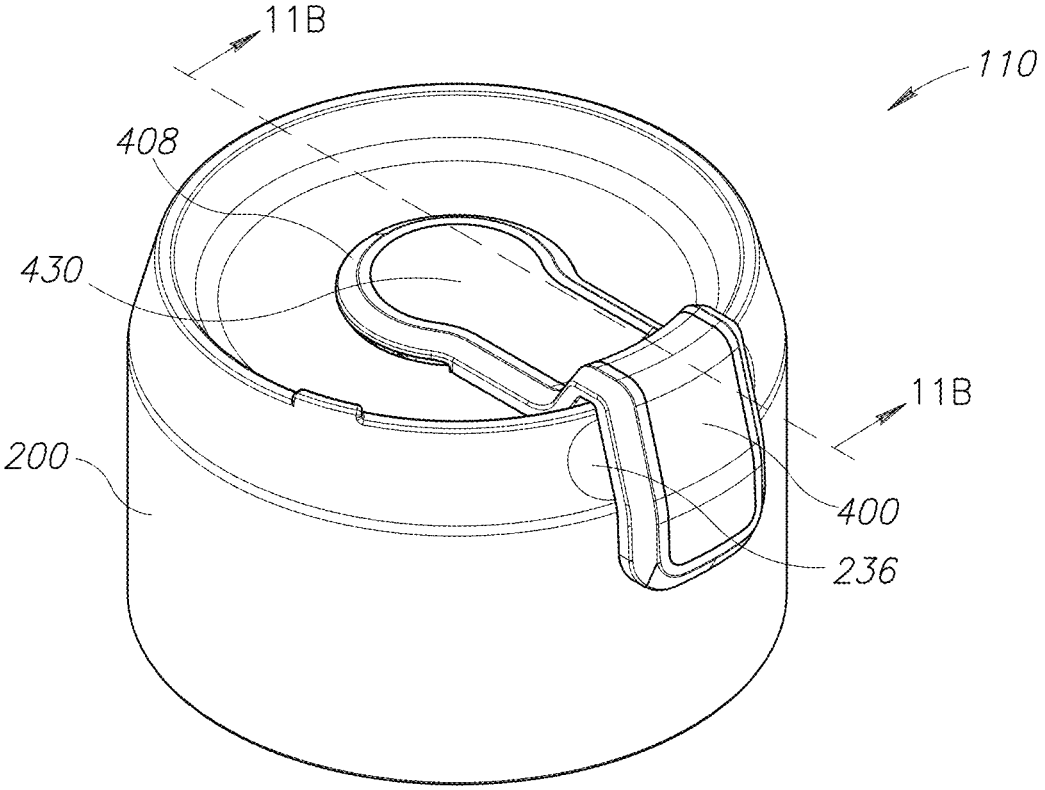
FIG. 11A is a top perspective view of the lid assembly with the lever assembly positioned such that the lid assembly operates in a first (closed) mode of operation.
Figure 11B:
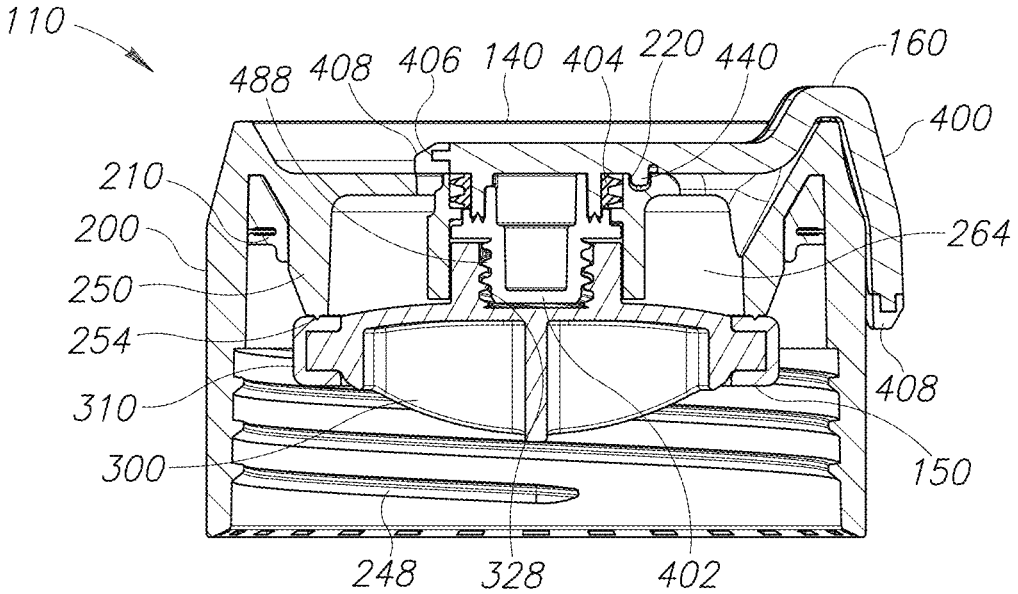
FIG. 11B is a cross-sectional view of the lid assembly taken through a line 11B-11B of FIG. 11A.
Figure 12A:
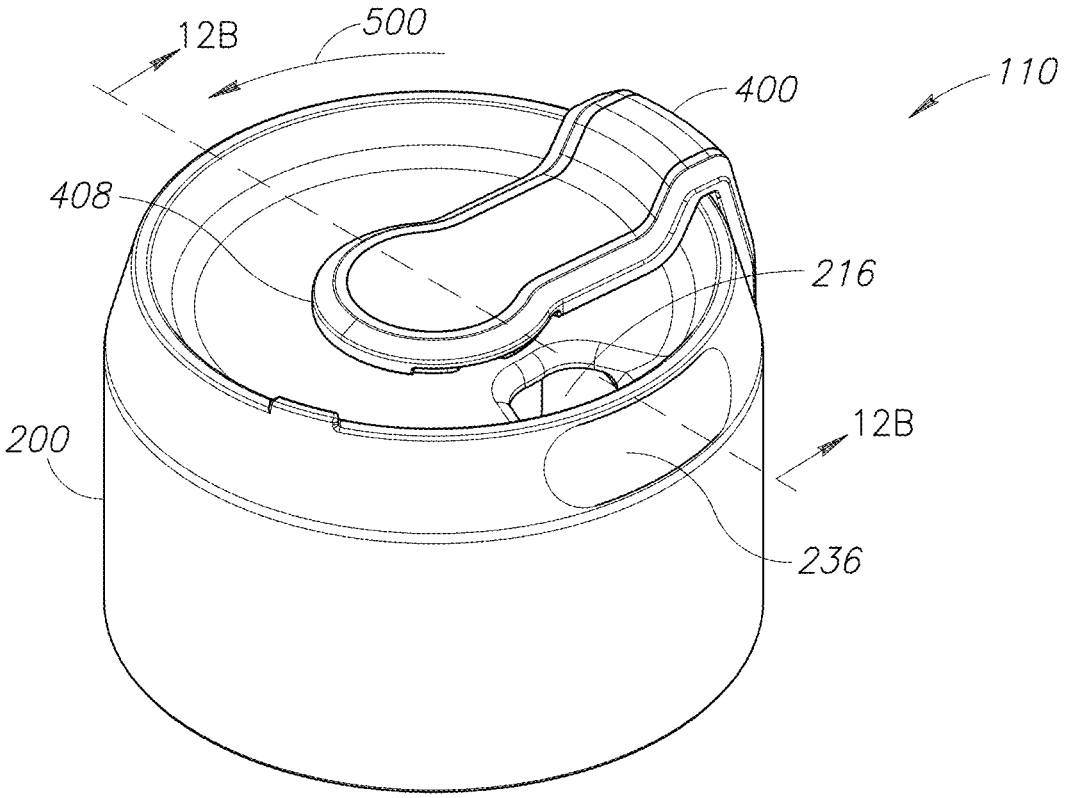
FIG. 12A is a top perspective view of the lid assembly with the lever assembly positioned such that the lid assembly operates in a second (hot) mode of operation.
Figure 12B:
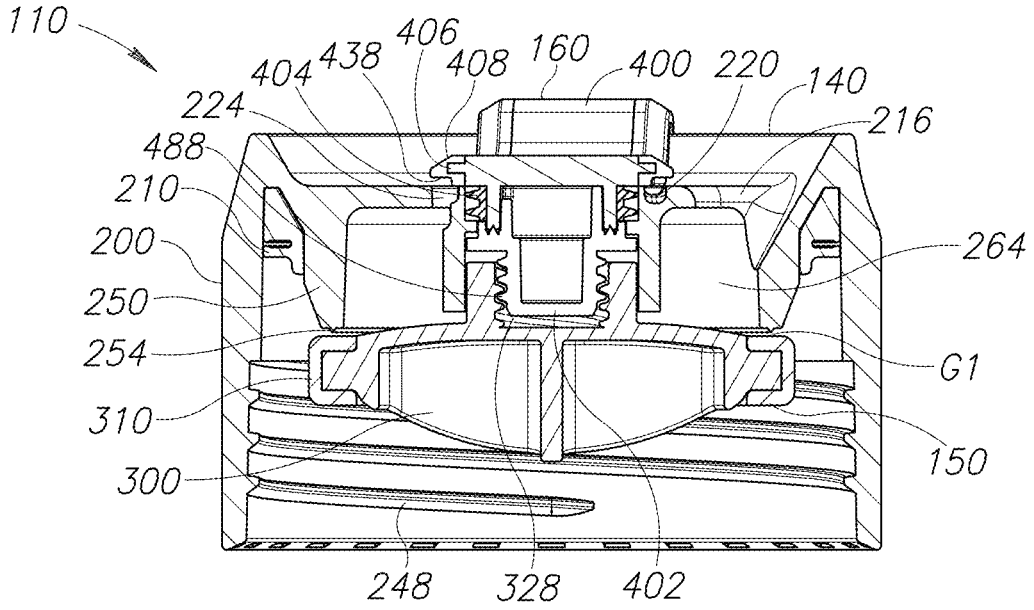
FIG. 12B is a cross-sectional view of the lid assembly taken through a line 12B-12B of FIG. 12A.
Figure 13A:
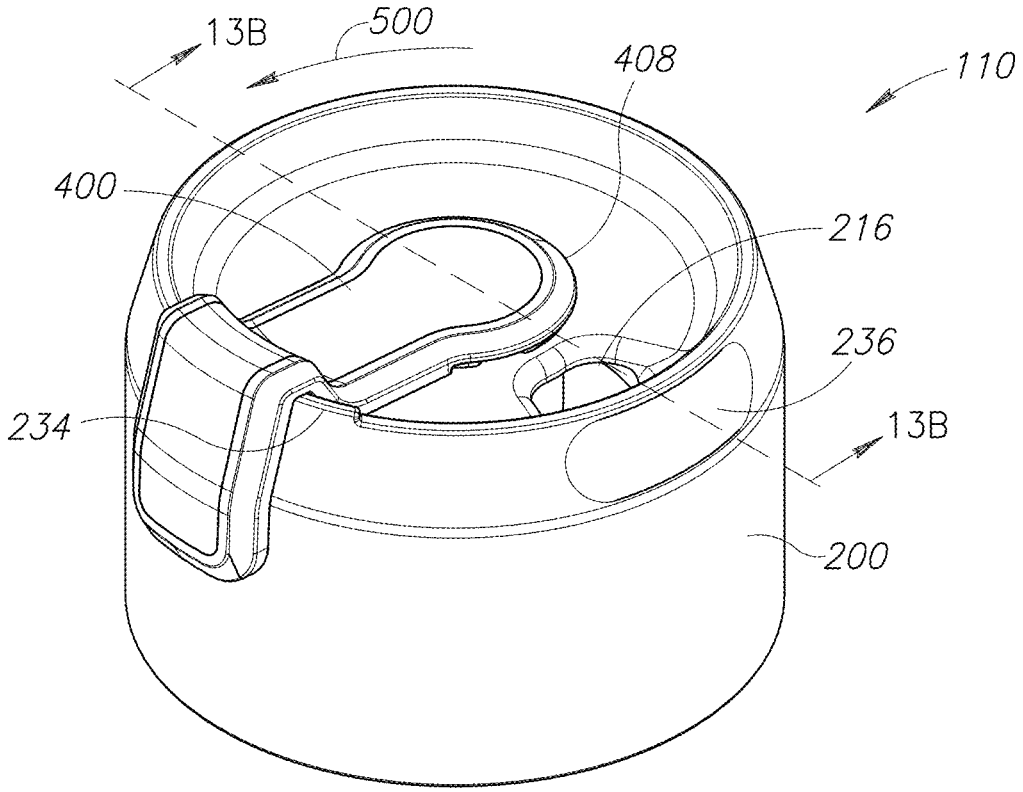
FIG. 13A is a top perspective view of the lid assembly with the lever assembly positioned such that the lid assembly operates in a third (cold) mode of operation.
Figure 13B:
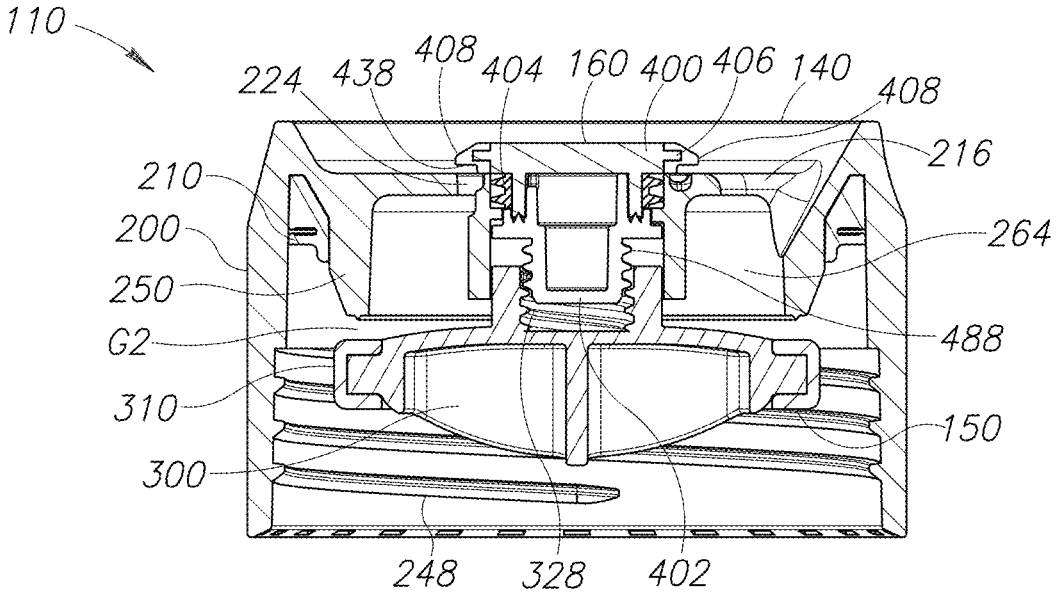
FIG. 13B is a cross-sectional view of the lid assembly taken through a line 13B-13B of FIG. 13A.
Figure 14A:
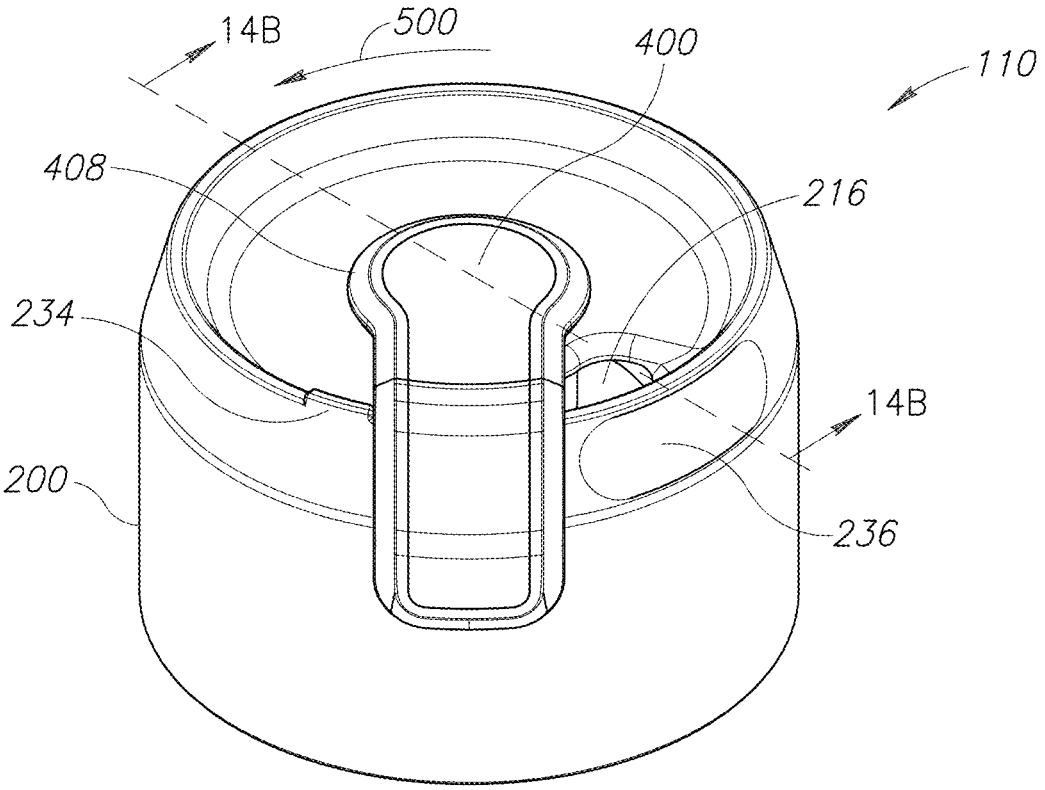
FIG. 14A is a top perspective view of the lid assembly with the lever assembly positioned such that the lid assembly operates in a fourth (cleaning) mode of operation.
Figure 14B:
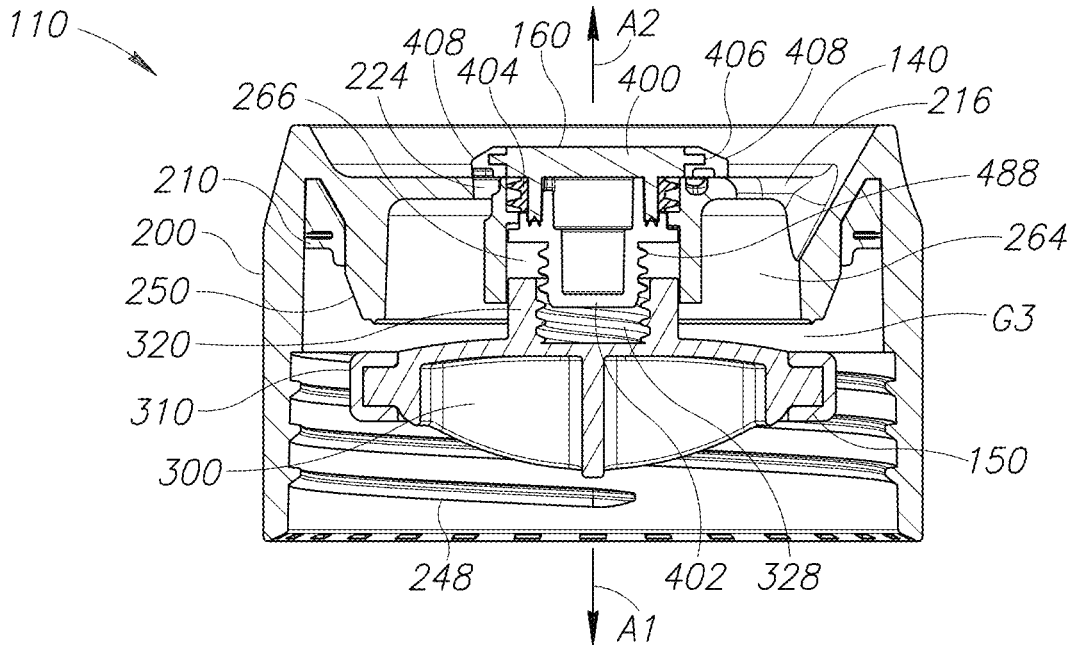
FIG. 14B is a cross-sectional view of the lid assembly taken through a line 14B-14B of FIG. 14A.

FIGS. 11A-14B illustrate the four modes of operation of the lid assembly 110. FIGS. 11A and 11B illustrate the lid assembly 110 in a closed configuration in which the lid assembly 110 operates in the first (closed) mode of operation. Referring to FIG. 11A, in this configuration, the lever member 400 covers the pouring aperture 216 (see FIGS. 3-5 and 12A-14B) and the underside 436 (see FIGS. 8 and 9) of the connector portion 430 of the lever member 400 covers the vent 224 (see FIGS. 3-5, 12B, and 13B). Referring to FIG. 11B, the projection 440 is positioned in the groove 220 within the first (closed) stop position "P1" (see FIG. 5). The projections 474 and 476 (see FIGS. 8 and 10) of the threaded member 402 abut the undersides of the ledges 274 and 276 (see FIGS. 4 and 5), respectively. The outside threads 488 of the threaded member 402 are threaded into the inside threads 328 of the stopper member 300 by a first closed amount. This causes the stopper member 300 to press the stopper seal 310 against the inner wall 250 and forms a fluid-tight seal therewith. The stopper seal 310 is pressed against the ring-shaped projection 254, when present. The fluid-tight seal prevents the liquid 116 (see FIG. 1) from entering the fluid chamber 264 and exiting the vessel 112 (see FIG. 1) through the pouring aperture 216 (see FIGS. 3-5 and 12A-14B).

FIGS. 12A and 12B illustrate the lid assembly 110 in a hot open configuration in which the lid assembly 110 operates in the second (hot) mode of operation. Referring to FIG. 12A, the lid assembly 110 may be transitioned to the hot open configuration from the closed configuration (see FIGS. 11A and 11B) by rotating the lever member 400 in a first direction (illustrated by a curved arrow "500") over the stop wall 222A (see FIG. 5) through the first region "R1" (see FIG. 5), over the stop wall 222B (see FIG. 5), and into the second (hot open) stop position "P2" (see FIG. 5). By way of a non-limiting example, the lever member 400 may be rotated in the first direction approximately 80 degrees from the first (closed) stop position "P1" (see FIG. 5) to the second (hot open) stop position "P2" (see FIG. 5). As mentioned above, the stops 270 and 272 (see FIGS. 4 and 5) of the lid body member 200, which retain the tracks 330 and 332 (see FIG. 6), respectively, of the stopper member 300, prevent the stopper member 300 from spinning with respect to the lid body assembly 140 (see FIGS. 2-4, 11B, 12B, 13B, and 14B). Thus, as the lever member 400 is rotated in the first direction, the threaded member 402 at least partially threads out of the stopper member 300.

In the hot open configuration, the lever member 400 is spaced apart from and does not obstruct the pouring aperture 216. Referring to FIG. 12B, as mentioned above, the projection 440 (see FIGS. 8, 9, and 11B) is positioned in the groove 220 within the second (hot open) stop position "P2" (see FIG. 5). The projections 474 and 476 (see FIGS. 8 and 10) of the threaded member 402 abut the undersides of the ledges 274 and 276 (see FIGS. 4 and 5), respectively. The outside threads 488 of the threaded member 402 are threaded into the inside threads 328 of the stopper member 300 by a second (hot) open amount that is less than the first closed amount (see FIG. 11B). This spaces the stopper member 300 and the stopper seal 310 apart from the inner wall 250 by the first distance (e.g., about 0.88 mm) and defines the first gap "G1" therebetween. The first gap "G1" allows the liquid 116 (see FIG. 1) to flow therethrough at the first (hot) flow rate (e.g., about 20 mL/s to about 50 mL/s). The recess 438 is positioned above the vent 224 and allows fluid communication between the fluid chamber 264 and the external environment outside the lid assembly 110. Thus, steam inside the vessel 112 (see FIG. 1) may escape therefrom through the vent 224. The vent 224 may also allow air to enter the vessel 112 (see FIG. 1) to prevent a vacuum (or lower pressure area) from forming inside the vessel as the liquid 116 (see FIG. 1) is poured out through the pouring aperture 216 during drinking.

Referring to FIG. 12A, the lid assembly 110 may be transitioned from the hot open configuration back to the closed configuration (see FIGS. 11A and 11B) by rotating the lever member 400 in a second direction (opposite the direction illustrated by the curved arrow "500") and positioning the projection 440 within the first (closed) stop position "P1" (see FIG. 5).

FIGS. 13A and 13B illustrate the lid assembly 110 in a cold open configuration in which the lid assembly 110 operates in the third (cold) mode of operation. Referring to FIG. 13A, the lid assembly 110 may be transitioned to the cold open configuration from the hot open configuration (see FIGS. 12A and 12B) by rotating the lever member 400 in the first direction (illustrated by the curved arrow "500") over the stop wall 222C (see FIG. 5), through the second region "R2" (see FIG. 5), over the stop wall 222D (see FIG. 5), and into the third (cold open) stop position "P3" (see FIG. 5). By way of a non-limiting example, the lever member 400 may be rotated in the first direction a total of approximately 270 degrees from the first (closed) stop position "P1" (see FIG. 5) to the third (cold open) stop position "P3" (see FIG. 5). As explained above, the threaded member 402 at least partially threads out of the stopper member 300 as the lever member 400 is rotated in the first direction.

In the cold open configuration, the lever member 400 is spaced apart from and does not obstruct the pouring aperture 216. The lever member 400 may abut the cleaning mode stop 234, which halts its rotation in the first direction (illustrated by the curved arrow "500"). Referring to FIG. 13B, as mentioned above, the projection 440 (see FIGS. 8, 9, and 11B) is positioned in the groove 220 within the third (cold open) stop position "P3" (see FIG. 5). The projections 474 and 476 (see FIGS. 8 and 10) of the threaded member 402 abut the undersides of the ledges 274 and 276 (see FIGS. 4 and 5), respectively. The outside threads 488 of the threaded member 402 are threaded into the inside threads 328 of the stopper member 300 by a third (cold) open amount that is less than the second (hot) open amount (see FIG. 12B). This spaces the stopper member 300 and the stopper seal 310 apart from the inner wall 250 by the second distance (e.g., about 3 mm) and defines the second gap "G2" therebetween. The second gap "G2" is larger than the first gap "G1" (see FIG. 11B) and allows the liquid 116 (see FIG. 1) to flow therethrough at the second (cold) flow rate (e.g., about 60 mL/s). As mentioned above, the second (cold) flow rate is faster than the first (hot) flow rate. The recess 438 is positioned above the vent 224 and allows fluid communication between the fluid chamber 264 and the external environment outside the lid assembly 110. Thus, steam inside the vessel 112 (see FIG. 1) may escape therefrom through the vent 224.

Referring to FIG. 13A, the lid assembly 110 may be transitioned from the cold open configuration back to the hot open configuration (see FIGS. 12A and 12B) by rotating the lever member 400 in the second direction (opposite the direction illustrated by the curved arrow "500") and positioning the projection 440 within the second (hot open) stop position "P2" (see FIG. 5).

FIGS. 14A and 14B illustrate the lid assembly 110 in a cleaning configuration in which the lid assembly 110 operates in the fourth (cleaning) mode of operation. Referring to FIG. 14A, the lid assembly 110 may be transitioned to the cleaning configuration from the cold open configuration by lifting the grip portion 432 of the lever member 400 causing the lever member 400 to flex so that the grip portion 432 clears the cleaning mode stop 234. While the grip portion 432 is lifted, the lever member 400 is rotated in the first direction (illustrated by the curved arrow "500") past the cleaning mode stop 234, over the stop wall 222E (see FIG. 5), and into the fourth (cleaning) stop position "P4" (see FIG. 5). By way of a non-limiting example, the lever member 400 may be rotated in the first direction a total of approximately 320 degrees from the first (closed) stop position "P1" (see FIG. 5) to the fourth (cleaning) stop position "P4" (see FIG. 5). Referring to FIG. 14B, in the fourth (cleaning) mode, the projection 440 (see FIGS. 8, 9, and 11B) is positioned in the groove 220 within the fourth (cleaning) stop position "P4" (see FIG. 5). Rotating the lever member 400 from the third (cold open) stop position "P3" (see FIG. 5) to the fourth (cleaning) stop position "P4" (see FIG. 5) unthreads the outside threads 488 of the threaded member 402 from the inside threads 328 of the stopper member 300, detaching the threaded member 402 from the stopper member 300.

When the threaded member 402 is detached from the stopper member 300, the upper anchor portion 320 of the stopper member 300 is maintained inside the through-channel 266 by the tabs 340 and 342 (see FIG. 6), which rest upon the stops 270 and 272 (see FIGS. 4 and 5). This spaces the stopper seal 310 apart from the inner wall 250 by the third distance (e.g., about 3.55 mm) and defines the third gap "G3" therebetween. The third gap "G3" is larger than the second gap "G2" (see FIG. 13B). Optionally, the liquid 116 (see FIG. 1) may flow through the third gap "G3" at the third (maximum) flow rate.

Referring to FIG. 14A, the lid assembly 110 may be transitioned from the cleaning configuration back to the cold open configuration by pressing the stopper assembly 150 toward the lever assembly 160 until the outside threads 488 of the threaded member 402 engage the inside threads 328 of the stopper member 300. Then, the lever assembly 160 may be rotated in the second direction (opposite the direction illustrated by the curved arrow "500") to thread the outside threads 488 into the inside threads 328. Next, the grip portion 432 of the lever member 400 is lifted, causing the lever member 400 to flex so that the grip portion 432 clears the cleaning mode stop 234. While the grip portion 432 is lifted, the lever member 400 is rotated in the second direction past the cleaning mode stop 234 to position the projection 440 within the third (cold open) stop position "P3" (see FIG. 5).

Alternatively, when the threaded member 402 is detached from the stopper member 300, the stopper assembly 150 may be separated from the lid body assembly 140 by pulling on the stopper assembly 150 (e.g., in the direction identified by the arrow "A1") with sufficient force to pull the tabs 340 and 342 (see FIG. 6) over the stops 270 and 272 (see FIGS. 4 and 5) and unsnap the snap fit between the lid body member 200 and the stopper assembly 150.

When the projection 440 (see FIGS. 8, 9, and 11B) is within the fourth (cleaning) stop position "P4" (see FIG. 5), the projections 474 and 476 (see FIGS. 8 and 10) of the threaded member 402 are aligned with the gaps 280 and 282 (see FIG. 5), respectively, defined between the ledges 274 and 276 allowing the lever assembly 160 to be removed from the through-channel 266 (see FIGS. 3-5) by lifting the lever assembly 160 vertically relative to the lid body member 200 (e.g., in the direction identified by the arrow "A2"). Thus, in the fourth (cleaning) mode, the lid body assembly 140, the stopper assembly 150, and the lever assembly 160 may be separated from one another and cleaned. When the assemblies 140, 150, and 160 are disassembled, the user can more easily clean them.

Referring to FIG. 14B, the lid assembly 110 may be reassembled by snapping the stopper assembly 150 into the lid body member 200. The stopper assembly 150 may be snapped into the lid body member 200 by inserting the stopper assembly 150 into the lid body assembly 140 (in the direction identified by the arrow "A2") and pressing the tabs 340 and 342 (see FIG. 6) over the stops 270 and 272 (see FIGS. 4 and 5), respectively, so that the tabs 340 and 342 are with the tracks 330 and 332 (see FIG. 6), respectively. Next, the lever assembly 160 is inserted (in the direction identified by the arrow "A1") into the through-channel 266. The stopper assembly 150 may be pressed toward the lever assembly 160 until the outside threads 488 of the threaded member 402 engage the inside threads 328 of the stopper member 300. Then, the lever assembly 160 may be rotated (e.g., about the longitudinal axis "L" illustrated in FIGS. 1 and 2) to thread the outside threads 488 into the inside threads 328. This rotation may continue until the inside threads 328 encounter the thread stop 486 (see FIG. 8). At this point, the projection 440 is positioned in the groove 220.

As mentioned above, a vertical distance between the stopper seal 310 and the inner wall 250 determines the flow rate of the liquid 116 (see FIG. 1) through the lid assembly 110. For example, FIGS. 12A-13B illustrate the different first and second distances between the stopper seal 310 and the inner wall 250 that provide the first (hot) and second (cold) flow rates. Other flow rates may be achieved by positioning the projection 440 within the first or second regions "R1" and "R2" (see FIG. 5). Thus, referring to FIG. 11B, the user may select a flow rate (e.g., from about 10 mL/s to about 20 mL/s or from about 10 mL/s to about 50 mL/s) that is slower than the first (hot) flow rate by positioning the lever member 400 to place the projection 440 in the first region "R1" (see FIG. 5). Similarly, the user may select a flow rate (e.g., from about 20 mL/s to about 60 mL/s or from about 50 mL/s to about 60 mL/s) that is faster than the first (hot) flow rate and slower than the second (cold) flow rate by positioning the lever member 400 to place the projection 440 in the second region "R2" (see FIG. 5). Thus, the user can selectively rotate the lever member 400 (e.g., within the first or second regions "R1" and "R2" illustrated in FIG. 5) to achieve a particular flow rate of the liquid 116 (see FIG. 1) through the lid assembly 110.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A lid assembly comprising:

a lid body member comprising a pouring aperture, a first inner wall, and a second inner wall, the second inner wall being spaced inwardly from the first inner wall, a fluid chamber being defined at least in part between the first and second inner walls, the pouring aperture being in fluid communication with the fluid chamber, the second inner wall defining a through-channel;

a flow control that is moveable with respect to the lid body member, the flow control comprising a first threaded portion positioned inside the through-channel; and a stopper assembly comprising a second threaded portion, the flow control being operable to move the stopper assembly between first and second open positions with respect to the first inner wall when the flow control is moved with respect to the lid body member, the second threaded portion engaging the first threaded portion inside the through-channel by first and second amounts when the stopper assembly is in the first and second open positions, respectively, the second amount being greater than the first amount, the stopper assembly being non-rotatable with respect to the lid body member when the stopper assembly is in the first and second open positions, the stopper assembly being spaced apart from the first inner wall by a first distance when the stopper assembly is in the first open position, the stopper assembly being spaced apart from the first inner wall by a second distance when the stopper assembly is in the second open position, the second distance being greater than the first distance, the first and second distances allowing a fluid to flow between the first inner wall and the stopper assembly, into the fluid chamber, and out the pouring aperture at first and second flow rates, respectively, the first flow rate being less than the second flow rate.

2. The lid assembly of claim 1, wherein the flow control is rotatable with respect to the lid body member between first and second positions, the stopper assembly is connected to the flow control and is movable by the flow control as the flow control is rotated, and the flow control positions the stopper assembly in the first and second open positions when the flow control is in the first and second positions, respectively.

3. The lid assembly of claim 2, wherein the flow control is rotatable with respect to the lid body member to a third position, the flow control positions the stopper assembly in a closed position when the flow control is in the third position, and the stopper assembly forms a fluid tight seal with the first inner wall when the stopper assembly is in the closed position.

4. The lid assembly of claim 3, wherein the flow control is rotatable with respect to the lid body member to a fourth position, the flow control comprises a projection, the lid body member comprises a pair of ledges that extend into the through-channel, a gap is defined between the pair of ledges and along the second inner wall, and the projection is positioned to travel through the gap only when the flow control is in the fourth position.

5. The lid assembly of claim 4, wherein the flow control positions the stopper assembly in a cleaning position when the flow control is in the fourth position, and the second threaded portion is disengaged from the first threaded portion when the stopper assembly is in the cleaning position.

6. The lid assembly of claim 1, wherein the stopper assembly comprises a track, the second inner wall comprises a stop that extends into the through-channel, the track is configured to receive the stop, and engagement between the stop and the track prevents the stopper assembly from rotating with respect to the lid body member as the flow control is moved with respect to the lid body member.

7. The lid assembly of claim 6, wherein the stopper assembly comprises a tab positioned in the track, and the tab helps maintain the stop inside the track.

8. The lid assembly of claim 1, wherein the flow control comprises a seal positioned inside the through-channel, and the seal is configured to form a fluid tight seal between the flow control and the second inner wall of the lid body member.

9. The lid assembly of claim 1, wherein the flow control is rotatable with respect to the lid body member between first and second positions, the stopper assembly is connected to the flow control and is movable by the flow control as the flow control is rotated, the flow control positions the stopper assembly in the first and second open positions when the flow control is in the first and second positions, respectively, the flow control is rotatable with respect to the lid body member to a third position, the flow control positions the stopper assembly in a closed position when the flow control is in the third position, the stopper assembly forms a fluid tight seal with the first inner wall when the stopper assembly is in the closed position, the lid body member comprises a groove with stop walls defining first, second, and third stop positions, the flow control comprises a projection configured to travel within the groove as the flow control is rotated, the flow control is in the third position when the projection is positioned in the first stop position, the flow control is in the first position when the projection is positioned in the second stop position, and the flow control is in the second position when the projection is positioned in the third stop position.

10. The lid assembly of claim 1, wherein the flow control is rotatable with respect to the lid body member between first and second positions, the stopper assembly is connected to the flow control and is movable by the flow control as the flow control is rotated, the flow control positions the stopper assembly in the first and second open positions when the flow control is in the first and second positions, respectively, the flow control is rotatable with respect to the lid body member to a third position, the flow control positions the stopper assembly in a closed position when the flow control is in the third position, the stopper assembly forms a fluid tight seal with the first inner wall when the stopper assembly is in the closed position, the stopper assembly comprises a stopper seal, and the stopper seal is pressed against the first inner wall to form the fluid tight seal when the stopper assembly is in the closed position.

11. The lid assembly of claim 1, wherein the flow control is rotatable with respect to the lid body member between first and second positions, the stopper assembly is connected to the flow control and is movable by the flow control as the flow control is rotated, the flow control positions the stopper assembly in the first and second open positions when the flow control is in the first and second positions, respectively, the flow control is rotatable with respect to the lid body member to a third position, the flow control positions the stopper assembly in a closed position when the flow control is in the third position, the stopper assembly forms a fluid tight seal with the first inner wall when the stopper assembly is in the closed position, the lid body member comprises a vent, the flow control blocks the vent and prevents fluid communication between the fluid chamber and an outside environment when the flow control is in the third position, the flow control comprises a recess configured to be positioned adjacent the vent when the flow control is in the first position or the second position, and the recess allows fluid communication between the fluid chamber and the outside environment through the vent when the flow control is in the first position or the second position.

12. The lid assembly of claim 1, wherein the first flow rate ranges from approximately 20 mL/s to approximately 50 mL/s.

13. The lid assembly of claim 1, wherein the second flow rate is approximately 60 mL/s.

14. The lid assembly of claim 1, wherein the flow control is rotatable with respect to the lid body member between first and second positions, the flow control positions the stopper assembly in the first and second open positions when the flow control is in the first and second positions, respectively, and the flow control is positionable between the first and second positions to position the stopper assembly between the first and second open positions and achieve a third flow rate that is faster than the first flow rate and slower than the second flow rate.

15. The lid assembly of claim 14, wherein the flow control is rotatable with respect to the lid body member to a third position, the flow control positions the stopper assembly in a closed position when the flow control is in the third position, the stopper assembly forms a fluid tight seal with the first inner wall when the stopper assembly is in the closed position, and the flow control is positionable between the third and first positions to position the stopper assembly between the closed position and the first open position and achieve a fourth flow rate that is slower than the first flow rate.

16. A lid assembly comprising:

a lid body member comprising a pouring aperture configured to allow a fluid to flow therethrough;

a stopper comprising a threaded portion, the stopper being coupled to the lid body member, the stopper being positionable in a closed position, a first open position, and a second open position, the stopper preventing the fluid from flowing through the pouring aperture when the stopper is in the closed position, the stopper allowing the fluid to flow through the pouring aperture at a first flow rate when the stopper is in the first open position, the stopper allowing the fluid to flow through the pouring aperture at a second flow rate when the stopper is in the second open position, the second flow rate being faster than the first flow rate; and a flow control comprising a flow control member and a threaded member, the flow control being operable to position the stopper in the closed position, the first open position, and the second open position, the flow control member being configured to be rotated manually by a user with respect to the lid body member, the threaded portion of the stopper being configured to threadedly engage the threaded member, the stopper not rotating with respect to the lid body member when the flow control member is rotated, the threaded member being non-rotatable with respect to the flow control member, rotating the flow control member in a first direction at least partially unthreading the threaded member from the threaded portion, rotating the flow control member in a different second direction threading the threaded member into the threaded portion, an amount by which the threaded member is threaded into the threaded portion determining whether the stopper is in the closed position, the first open position, or the second open position.

17. The lid assembly of claim 16, wherein the flow control comprises a seal that forms a liquid tight seal between the flow control member and the lid body member.

18. The lid assembly of claim 16, wherein the lid body member comprises a groove with first, second, and third stop positions, the flow control member comprises a projection, the stopper is in the closed position when the flow control member is rotated to position the projection in the first stop position, the stopper is in the first open position when the flow control member is rotated to position the projection in the second stop position, and the stopper is in the second open position when the flow control member is rotated to position the projection in the third stop position.

19. The lid assembly of claim 16, wherein the flow control member is a lever member, a dial, or a knob.

20. A beverage container comprising:

a vessel configured to store a liquid, the vessel having a threaded opening; and a lid assembly configured to thread onto the threaded opening, the lid assembly comprising a lid body member, a stopper assembly, and a flow control, the lid body member comprising a pouring aperture, a first inner wall, and a second inner wall, the second inner wall being spaced inwardly from the first inner wall, a fluid chamber being defined at least in part between the first and second inner walls, the pouring aperture being in fluid communication with the fluid chamber, the second inner wall defining a through-channel, the flow control comprising a first threaded portion positioned inside the through-channel, the flow control being moveable with respect to the lid body member, the stopper assembly comprising a second threaded portion, the flow control being operable to move the stopper assembly between first and second open positions with respect to the first inner wall when the flow control is moved with respect to the lid body member, the second threaded portion engaging the first threaded portion inside the through-channel by first and second amounts when the stopper assembly is in the first and second open positions, respectively, the second amount being greater than the first amount, the stopper assembly being non-rotatable with respect to the lid body member when the stopper assembly is in the first and second open positions, the stopper assembly being spaced apart from the first inner wall by a first distance when the stopper assembly is in the first open position, the stopper assembly being spaced apart from the first inner wall by a second distance when the stopper assembly is in the second open position, the second distance being greater than the first distance, the first and second distances allowing a fluid to flow between the first inner wall and the stopper assembly, into the fluid chamber, and out the pouring aperture at first and second flow rates, respectively, the first flow rate being less than the second flow rate.

21. The beverage container of claim 20, wherein the threaded opening comprises an upper edge portion; and the lid assembly comprises a seal configured to form a fluid tight seal between the upper edge portion and the lid assembly.

22. The beverage container of claim 20, wherein the flow control is rotatable with respect to the lid body member, rotating the flow control member-in a first direction at least partially unthreads the first threaded portion from the second threaded portion, rotating the flow control in a different second direction threads the first threaded portion into the second threaded portion, and an amount by which the first threaded portion is threaded into the second threaded portion determines whether the stopper assembly is in the first open position or the second open position.

23. The beverage container of claim 22, wherein the lid body member comprises a groove with first, second, and third stop positions, the flow control comprises a projection configured to travel within the groove as the flow control is moved with respect to the lid body member, the stopper assembly is in the first open position when the flow control is rotated to position the projection in the first stop position, the stopper assembly is in the second open position when the flow control is rotated to position the projection in the second stop position, and the stopper assembly is in a third position when the flow control is rotated to position the projection in the third stop position, the stopper assembly being configured to prevent a liquid from flowing through the pouring aperture when the stopper assembly is in the third position.

24. A lid assembly comprising:

a lid body member comprising a pouring aperture, an inner wall, and a groove with stop walls, the stop walls defining first, second, and third stop positions, the inner wall defining at least a portion of a fluid chamber, the pouring aperture being in fluid communication with the fluid chamber;

a flow control that is rotatable with respect to the lid body member to first, second, and third positions, the flow control comprising a projection configured to travel within the groove as the flow control is rotated, the flow control being in the third position when the projection is positioned in the first stop position, the flow control being in the first position when the projection is positioned in the second stop position, the flow control being in the second position when the projection is positioned in the third stop position; and a stopper assembly connected to the flow control and being movable by the flow control as the flow control is rotated, the flow control being operable to move the stopper assembly between first and second open positions with respect to the inner wall when the flow control is rotated with respect to the lid body member, the flow control positioning the stopper assembly in the first and second open positions when the flow control is in the first and second positions, respectively, the stopper assembly being spaced apart from the inner wall by a first distance when the stopper assembly is in the first open position, the stopper assembly being spaced apart from the inner wall by a second distance when the stopper assembly is in the second open position, the second distance being greater than the first distance, the first and second distances allowing a fluid to flow between the inner wall and the stopper assembly, into the fluid chamber, and out the pouring aperture at first and second flow rates, respectively, the first flow rate being less than the second flow rate, the flow control positioning the stopper assembly in a closed position when the flow control is in the third position, the stopper assembly forming a fluid tight seal with the inner wall when the stopper assembly is in the closed position.

25. The lid assembly of claim 24, wherein the inner wall is a first inner wall, the lid body member comprises a second inner wall spaced inwardly from the first inner wall, the fluid chamber is defined at least in part between the first and second inner walls, the second inner wall defines a through-channel, the flow control is rotatable with respect to the lid body member to a fourth position, the projection is a first projection, the flow control comprises a second projection positioned inside the through-channel, the lid body member comprises a pair of ledges that extend into the through-channel, a gap is defined between the pair of ledges and along the second inner wall, and the second projection is positioned to travel through the gap only when the flow control is in the fourth position.

26. The lid assembly of claim 25, wherein the flow control comprises a first threaded portion positioned inside the through-channel, the stopper assembly comprises a second threaded portion engaging the first threaded portion inside the through-channel, the flow control positions the stopper assembly in a cleaning position when the flow control is in the fourth position, and the second threaded portion is disengaged from the first threaded portion when the stopper assembly is in the cleaning position.

27. The lid assembly of claim 24, wherein the inner wall is a first inner wall, the lid body member comprises a second inner wall spaced inwardly from the first inner wall, the fluid chamber is defined at least in part between the first and second inner walls, the second inner wall defines a through-channel, the stopper assembly comprises a track, the second inner wall comprises a stop that extends into the through-channel, the track is configured to receive the stop, and engagement between the stop and the track prevents the stopper assembly from rotating with respect to the lid body member as the flow control is rotated with respect to the lid body member.

28. The lid assembly of claim 27, wherein the stopper assembly comprises a tab positioned in the track, and the tab helps maintain the stop inside the track.

29. The lid assembly of claim 24, wherein the inner wall is a first inner wall, the lid body member comprises a second inner wall spaced inwardly from the first inner wall, the fluid chamber is defined at least in part between the first and second inner walls, the second inner wall defines a through-channel, the flow control comprises a seal positioned inside the through-channel, and the seal is configured to form a fluid tight seal between the flow control and the second inner wall of the lid body member.

30. The lid assembly of claim 24, wherein the stopper assembly comprises a stopper seal, and the stopper seal is pressed against the inner wall to form the fluid tight seal when the stopper assembly is in the closed position.

31. The lid assembly of claim 24, wherein the lid body member comprises a vent, the flow control blocks the vent and prevents fluid communication between the fluid chamber and an outside environment when the flow control is in the third position, the flow control comprises a recess configured to be positioned adjacent the vent when the flow control is in the first position or the second position, and the recess allows fluid communication between the fluid chamber and the outside environment through the vent when the flow control is in the first position or the second position.

32. The lid assembly of claim 24, wherein the first flow rate ranges from approximately 20 mL/s to approximately 50 mL/s.

33. The lid assembly of claim 24, wherein the second flow rate is approximately 60 mL/s.

34. The lid assembly of claim 24, wherein the flow control is positionable between the first and second positions to position the stopper assembly between the first and second open positions and achieve a third flow rate that is faster than the first flow rate and slower than the second flow rate.

35. The lid assembly of claim 34, wherein the flow control is positionable between the third and first positions to position the stopper assembly between the closed position and the first open position and achieve a fourth flow rate that is slower than the first flow rate.

* * * * *